United States Patent [19]

Kameta et al.

[11] Patent Number: 4,964,390

[45] Date of Patent: Oct. 23, 1990

[54] FUEL SUPPLY CONTROL APPARATUS FOR AN INTERNAL COMBUSTION ENGINE

[75] Inventors: Katsunobu Kameta; Kiyomi Morita; Takeshi Kikuchi; Yoshiyuki Tanabe, all of Katsuta, Japan

[73] Assignees: Hitachi, Ltd., Tokyo; Hitachi Automotive Engineering Co., Ltd., Ibaraki, both of Japan

[21] Appl. No.: 341,763

[22] Filed: Apr. 21, 1989

[30] Foreign Application Priority Data

Apr. 26, 1988 [JP] Japan ..... 63-101228

[51] Int. Cl.[5] ..... F02M 51/00

[52] U.S. Cl. ..... 123/489; 123/440

[58] Field of Search ..... 123/489, 440; 364/431.03

[56] References Cited

U.S. PATENT DOCUMENTS

| | | | |
|---|---|---|---|
| 4,800,857 | 1/1989 | Tomisawa | 123/489 |
| 4,850,326 | 7/1989 | Tomisawa | 123/489 |
| 4,852,010 | 7/1989 | Amano et al. | 364/431.03 |
| 4,854,287 | 8/1989 | Tomisawa | 123/489 |

*Primary Examiner*—Raymond A. Nelli

*Attorney, Agent, or Firm*—Antonelli, Terry, Stout & Kraus

[57] ABSTRACT

In a fuel supply control apparatus for an internal combustion engine having an A/F ratio feed-back control with a learning function, a difference between an A/F ratio detected by an oxygen sensor and the stoichiometric value is obtained and divided into an A/F ratio correction coefficient and an A/F ratio deviation coefficient in accordance with a predetermined gains ratio. The former coefficient is stored in an area of a correction map corresponding to an operational condition of the engine at that time and the latter coefficient is accumulated in an additional storage. Upon determination of an amount of fuel to be supplied, a former coefficient is read out from the map in response to the operational condition and added to the latter coefficient read out from the additional storage to form a correction value, which is used for correcting a preliminary fuel supply amount obtained in accordance with the operational condition to determine a final fuel supply amount. With this, a quick determination of the final fuel supply amount accordingto the operational condition of the engine can be performed.

13 Claims, 14 Drawing Sheets

TIMING OF LEARNING
TRANSITION DIRECTION
1
2
3
1
+20
λ
0
-20
d1
d2
d3
d4

FOR 1
FOR 2
FOR 3
KBLRC2
da1
da2
db1
dc1

KBLRC1
dx1
dx2
dx3
dx4
dx5

+10
KBLRC
dz1
dz2
dz3
dz4
dz5

TIMING OF LEARNING
TRANSITION DIRECTION
1
2
3
1
+20
λ
0
-20
$d_{12}$
$d_{11}$
$d_{13}$
$d_4$

0
FOR 1
$da_{11}$
$da_{11}$
$da_{12}$
-20
+20

KBLRC2
FOR 2
0
$db_{11}$
+20
FOR 3
$dc_{11}$
0

KBLRC1
0
$dx_{11}$
$dx_{12}$
$dx_{13}$
$dx_{14}$
-20
+10

KBLRC
0
$dz_{11}$
$dz_{12}$
$dz_{13}$
$dz_{14}$
-20

FUEL SUPPLY CONTROL APPARATUS FOR AN INTERNAL COMBUSTION ENGINE

BACKGROUND OF THE INVENTION

1. Field of the invention

The present invention relates to a fuel supply control apparatus for an internal combustion engine having an air/fuel (A/F) ratio feed-back control with a learning function, especially to the improvement of the efficiency of the learning operation in such a fuel supply control apparatus.

2. Description of the related art

As is well known, there has been widely employed an A/F ratio feed-back control, using an oxygen sensor, for controlling an A/F ratio of a fuel mixture supplied to an internal combustion engine. Further, recently, use of a so called learning function in such an A/F ratio control is receiving increasing attention, in order to improve the response in the A/F ratio control.

In an A/F ratio feed-back control system having a learning function, an actual A/F ratio of a fuel mixture is detected by a known oxygen sensor and an A/F ratio of a fuel mixture is controlled so as to make the actual value thereof follow a reference value, which is usually set at the stoichiometric A/F ratio. Data concerning a deviation between the actual value and the reference value are stored as correction values in areas of a correction map, each area corresponding to a particular operational condition, which is defined by, for example, the rotational speed of the engine and the load thereof.

When the engine encounters a certain operational condition during operation thereof, data stored in an area of the map corresponding to the certain operational condition is read out and an A/F ratio determined, for example, by an suction air amount and a rotational speed of the engine, is corrected on the basis of a correction value, i.e., the data read out from the map. With this, a fuel mixture can be always maintained at an appropriate A/F ratio, taking account of characteristics of a particular engine and operating circumstances thereof.

In the A/F ratio feed-back control system as mentioned above, as is well known, it is necessary to renew correction values stored in the map in accordance with changes in operating conditions of the engine. For example, even if the engine is operated at the same rotational speed and the same load, it is necessary to change the A/F ratio of a fuel mixture in accordance with the elevation of the road on which the automobile travels in order to make an actual A/F ratio follow the stoichiometric value more accurately.

When an automobile travels in a mountain district, for example, there frequently occurs cases where the elevation of the road changes widely and accordingly the atmospheric pressure changes. Namely, the operating conditions of an engine often changes.

In such cases, the learning operation as mentioned above and the renewal of data stored in a correction map must be repeated, every time the automobile encounters new traveling circumstances. According to circumstances, the renewal of data of the map can not be executed fast enough to obtain an appropriate correction value in time, and therefore the actual A/F ratio is made worse.

To improve this, there has been proposed a method of renewing data of a correction map as disclosed, for example, in the laid-open Japanese patent application No. JPA-59/25055 (published on Feb. 8, 1984).

According to this, there are provided two memories, in which a first one of the memories is equivalent to a correction map as described above and stores correction values in response to operational conditions of an engine. Data stored therein is subject to the renewal by means of a learning operation in the same manner as mentioned above.

A second memory stores data, which is obtained by averaging differences between a predetermined value and the correction values stored in selected areas, including at least some areas neighboring or surrounding a corresponding area, of the correction map.

When a final amount of fuel to be supplied to the engine is determined, data stored in an area of the map corresponding to the operational condition of the engine at that time is at first read out from the first memory. Then, the read-out data is combined with data stored in the second memory, whereby a correction value used for the determination of the final fuel supply amount is formed.

As will be understood from the foregoing, a concept underlying the prior art described above is as follows; when a factor, for which a correction value must be renewed, is extracted as the result of operation of the engine in a particular operational condition, the influence of the factor is brought on the operation of the engine in neighboring operational conditions.

Accordingly, although, when the operation of an engine changes to a neighboring operational condition, a correction value stored in an area of a correction map corresponding to the neighboring operational condition is read out, it is already corrected to a certain extent during the operation of the engine in the previous operational condition. Therefore, an appropriate A/F ratio can be determined quickly and therefore the response in the A/F ratio feed-back control is improved considerably.

However, the prior art as described above does not have a sufficient affect in the point of view of efficiently renewing data stored in the second memory, because the calculation for obtaining the average of differences of correction values stored in the selected areas of the correction map and the predetermined value must be carried out frequently.

SUMMARY OF THE INVENTION

An object of the present invention is to provide a fuel supply control apparatus for an internal combustion engine with the improved learning function, i.e., capable of performing a quick and efficient learning operation.

A feature of the present invention resides in a fuel supply control apparatus with an A/F ratio feed-back control, in which there is at first obtained a difference between an actual value of A/F ratio and a reference value thereof set for the feed-back control, the difference is divided into first and second components in accordance with predetermined ratio, the first component is stored in an area of a correction map corresponding to an operational condition of the engine, the second component is accumulated in an additional storage, and both the components are combined with each other when they are used as a correction value for finally determining an amount of fuel to be supplied to the engine.

According to this feature, one of the components consisting of a correction value can be easily obtained by dividing the result of the feed-back control in accordance with the predetermined ratios, which is a calculation easier than the averaging carried out in the prior art. Therefore, the learning operation according to the present invention is much more efficient.

Further, since an appropriate correction value can be quickly obtained by simply combining the components, a good response in A/F ratio control is secured, with the result that a fuel mixture supplied to an engine is always maintained at an appropriate value, even if operating conditions of the engine change frequently, for example, due to traveling of an automobile in a mountain district.

Moreover, according to a feature of an embodiment of the present invention, the control for coping with the change in the operating conditions, especially the change in the elevation of the road on which the automobile travels, is further improved. In the embodiment, there is introduced a concept of a real driving force, on which the difference in elevation of the road on which the automobile travels is calculated. The correction value used for finally determining a fuel supply amount is subject to the correction based on the thus obtained elevation difference.

DESCRIPTION OF THE PREFERRED EMBODIMENTS

In the following, a fuel supply control apparatus according to an embodiment of the present invention will be described, referring to accompanying drawings.

Figure 1:
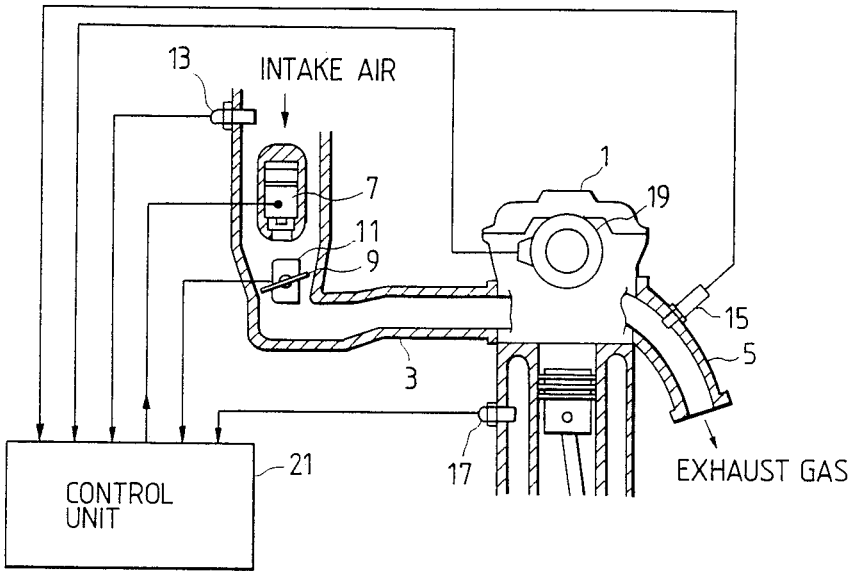
FIG. 1 schematically shows an example of an engine control system, to which a fuel supply control apparatus according to the present invention is applied.

FIG. 1 of the accompanying drawings schematically shows an example of an internal combustion engine control system, to which a fuel supply control apparatus of the embodiment is applied. As apparent from the figure, internal combustion engine 1 has a known structure, i.e., it is coupled with an intake pipe 3 for introducing intake air into the engine 1 and an exhaust pipe 5 for discharging exhaust gas from the engine 1.

The intake pipe 3 is provided with a fuel injector 7, which injects a predetermined amount of fuel into the intake pipe 3 in response to an injection pulse signal applied thereto, whereby a fuel mixture of a predetermined air/fuel (A/F) ratio is supplied to the engine 1. There is further provided a throttle valve 9 in the intake pipe 3, which controls the amount of intake air. The opening of the throttle valve 9 is detected by an opening sensor 11. Moreover, a temperature sensor 13 for detecting the temperature of the intake air is mounted in the intake pipe 3.

The exhaust pipe 5 is provided with an oxygen sensor 15, which detects the concentration of residual oxygen included in the exhaust gas discharged from the engine 1 and produces a signal representative of the actual A/F ratio of the mixture supplied to the engine 1.

On a cylinder block of the engine 1, there is installed a temperature sensor 17 for detecting the temperature of the cooling water of the engine 1. In the engine 1, there is further provided a crank angle sensor 19, which is driven by a crank shaft (not shown) of the engine 1 and detects the angle of the crank shaft and upper dead points of respective cylinders of the engine 1 to produce corresponding signals.

Output signals of the aforesaid sensors 11, 13, 15, 17 and 19 are coupled to a control unit 21. As already known, the control unit 21 includes a microprocessor and executes a predetermined data processing on the basis of the received signals. Generally, this data processing is as follows, although details thereof will be described later.

An amount of intake air of the engine 1 is at first calculated on the basis of the engine rotational speed, which is obtained from the crank angle signal outputted by the sensor 19, and a throttle valve opening signal from the sensor 11, as well as an air temperature signal from the sensor 13. An amount of fuel to be injected is determined in response to the calculated intake air amount. Further, the thus obtained fuel amount is corrected on the basis of an A/F ratio signal outputted from the sensor 15 to determine a final amount of fuel to be injected.

A pulse signal having a pulse width corresponding to the final amount of fuel to be injected is formed as an injection pulse signal, which actuates the injector 7 and causes it to inject a predetermined amount of fuel.

Figure 2:
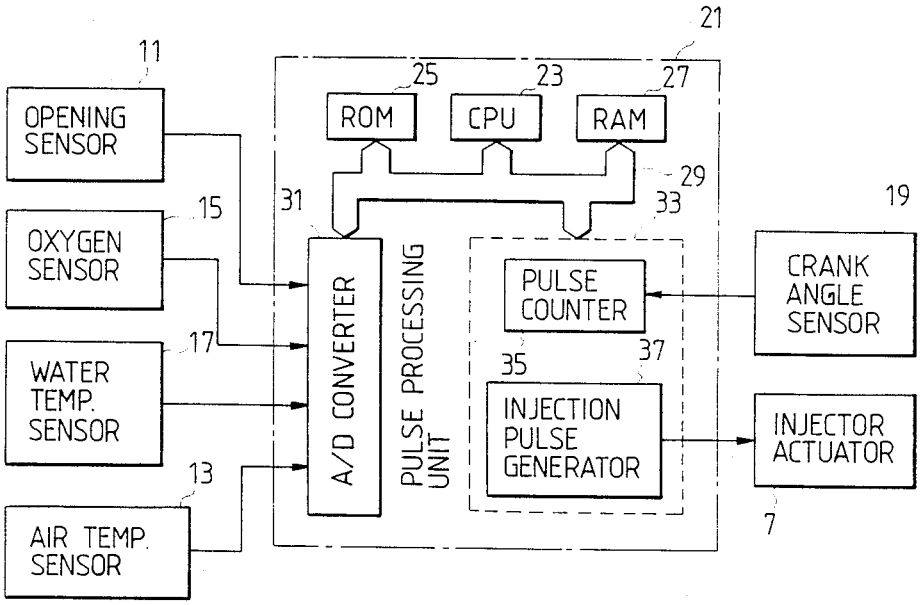
FIG. 2 is a block diagram schematically showing a configuration of a fuel supply control apparatus according to an embodiment of the present invention.

FIG. 2 is a block diagram schematically showing a configuration of the fuel supply control apparatus of the embodiment. As apparent from the figure, the control unit 21 includes a microprocessor composed of central processing unit (CPU) 23 for executing a predetermined data processing, read-only memory (ROM) 25 for storing programs to be executed by the CPU 23 for the predetermined data processing and various constants necessary for execution of the programs, and random access memory (RAM) 27 for storing data to be processed by the CPU 23 or processed results during execution of the programs.

The CPU 23, ROM 25 and RAM 27 are coupled with each other by common bus 29. Further, analog to digital (A/D) converter 31 is coupled to the common bus 29. The A/D converter 31 receives analog signals outputted by the various sensors 11, 13, 15 and 17 and converts them into digital signals. Furthermore, pulse processing unit 33 is coupled to the common bus 29, which includes pulse counter 35 for counting pulses produced by the crank angle sensor 19 to detect the rotational speed of the engine 1 and injection pulse generator 37 for generating the injection pulse signal on the basis of the result of processing by the microprocessor.

There is provided a power source for supplying an electric power to all the components described above, however it is omitted in the figure. Further, although those components are first activated by the power source when a starter key switch of the engine 1 is turned on, a part of the RAM 27 is provided with a backup electric power and always is supplied with electric power whether the switch is turned on or not. Therefore, the contents of the backed-up portion of the RAM 27 are preserved, even if the starter key switch is turned off.

Figure 3:
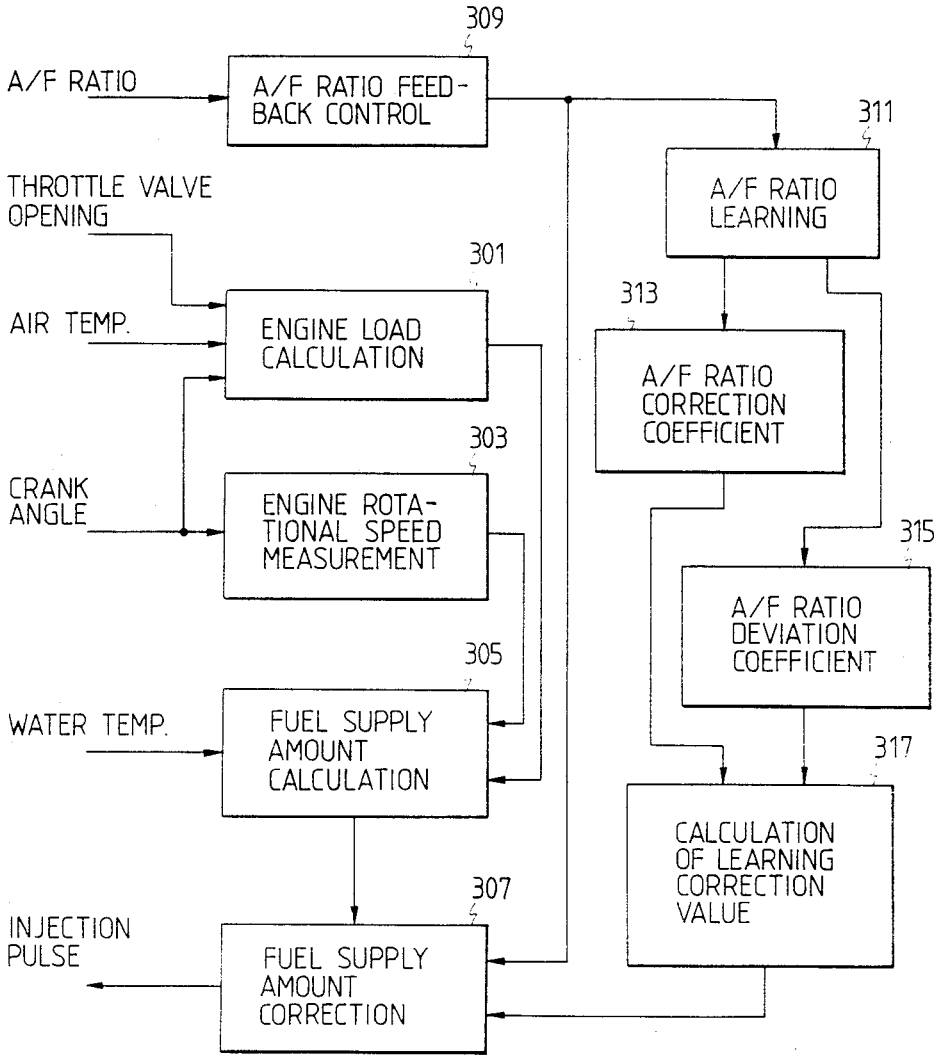
FIG. 3 is a functional block diagram for explaining the operation of the embodiment of FIG. 2.

In the following, the data processing executed by the control unit 21 will be described, referring next to FIG. 3 showing a functional block diagram of the data processing.

First of all, a load of the engine 1 is calculated on the basis of the throttle valve opening signal from the sensor 11, the air temperature signal from the sensor 13 and the crank angle signal from the sensor 19 (cf. block 301), and the rotational speed of the engine 1 is measured by using the crank angle signal (cf. block 303). Based on the engine load and rotational speed obtained in the blocks 301 and 303, an amount of fuel to be supplied is calculated (cf. block 305). As apparent from the figure, also the water temperature signal from the sensor 17 is taken into consideration for the calculation of the fuel supply amount in the block 305.

A signal representative of the thus determined fuel supply amount is sent to block 307, in which it is subject to the correction by means of an air/fuel ratio feed-back control (cf. blocks 307 and 309). This correction is carried out on the basis of an air excess ratio obtained in the block 309 from an A/F ratio signal given by the sensor 15. The injection pulse signal is produced on the basis of the corrected fuel supply amount.

As already described, the necessary extent of the correction changes according to the operational condition of the engine 1. Therefore, another factor for correction based on the operational condition is further taken into consideration for the correcting operation in the block 307. Values indicating the extent of this correction are stored in a table provided in the RAM 27 in advance. The table has plural areas which correspond to the respective operational conditions of the engine 1 and stores correction values in the areas corresponding to the particular operational conditions.

When the correction of the fuel supply amount determined in the block 305 is carried out, a correction value is read out in accordance with the operational condition of the engine 1 at that time. The correction values stored in the table are renewed in response to the control result, every time a corresponding one is used. In this manner, the correction values stored in the table are gradually renewed and adapted by the learning function.

The foregoing is the same as a known fuel supply control operation with an A/F ratio feed-back control. The learning function for the renewal of correction values according to the present invention is characterized by the following.

A correction value is at first obtained on the basis of the air excess ratio (cf. block 311). The obtained correction value is divided into two components, i.e., a first component, called an A/F ratio correction coefficient 313, which depends on the particular operational condition of the engine 1 (in this embodiment, the rotational speed and the load of the engine, as described later) and a second component, called an A/F ratio deviation coefficient 315, which is effective in common for the whole range of the operational conditions.

When a final fuel supply amount is to be determined, the A/F ratio correction coefficient is obtained in dependence upon the operational condition of the engine 1, which is combined with the A/F ratio deviation coefficient, whereby a learning correction value is obtained (cf. block 317). The thus obtained learning correction value is supplied to the block 307. The block 307 carries out the correction of the fuel supply amount determined in the block 305 on the basis of the two correction factor components as described above to produce the injection pulse signal.

The more detailed operation of the whole configuration of the block diagram of FIG. 3 will be explained with reference to a flow chart of FIG. 4, and a part thereof, i.e., the operation of a learning correction function consisting of the blocks 311, 313, 315 and 317, will be described further in detail with reference to flow charts of FIGS. 8 and 9.

Further, the blocks 313 and 315 included in the learning correction function are formed by appropriate storages provided in the power backed-up portion of the RAM 27 for storing the respective coefficients. For conveniences' sake, before the description of the detailed operation, the blocks 313 and 315 will be described below, referring to FIG. *7a* and *7b*. Further, in the following, the storages used for achieving the blocks 313 and 315 will be denoted by the same reference numerals 313 and 315, respectively.

The correction coefficients of the block 313 are stored in an A/F ratio correction map provided in the backed-up portion of the RAM 27, which comprises a pair of maps 313, 313'. Each map has plural areas defined by the operational condition of the engine 1, i.e., the rotational speed N and the charging efficiency Q in the embodiment, as shown in FIGS. *7a* and *7b*. Every area in both the maps 313, 313' corresponds to each other with respect to the operational condition of the engine 1.

One of the maps 313 is an A/F ratio correction coefficient map, as shown in FIG. *7a*, in each area of which an A/F ratio correction coefficient is stored in accordance with an operational condition of the engine 1. The other map 313' is a counter map having plural areas, each of which stores a number of times of the learning operation of an A/F ratio correction coefficient stored in a corresponding area of the correction coefficient map. For this purpose, the map 313' has the same structure as that of the map 313, as shown in FIG. *7b*.

The deviation coefficient of the block 315 is stored in additional storage 315 provided in the backed-up portion of the RAM 27. It is to be noted that this storage 315 has no storage area depending on the operational condition of the engine 1. Further, as shown in FIG. *7a*, this storage 315 operates cooperatively with the correction coefficient map 313.

As already described briefly, a correction coefficient, which is obtained by the A/F ratio learning function of the block 311, is divided into two components KBLRC2 and KBLRC1 in accordance with predetermined proportion or ratio. These components correspond to the aforesaid A/F ratio correction coefficient and A/F ratio deviation coefficient, respectively. The component KBLRC2 is stored as KBLRC2(N,Q) in an area of the map 313 corresponding to the operational condition of the engine 1, under which the learning operation is carried out. The component KBLRC1 is always stored in the storage 315, irrespective of the operational condition of the engine 1.

Further, every time the component KBLRC2(N,Q) of a new correction value obtained by the learning operation is written in an area of the correction value map 313, the content NBLRC(N,Q) of a corresponding area of the counter map 313' is increased by one, and the new NBLRC(N,Q) is stored in the corresponding area, again.

When the correction for obtaining a final fuel supply amount is carried out, the coefficient KBLRC2(N,Q) read out from the map 313 in response to the operational condition of engine 1 at that time and the coefficient KBLRC1 read out from the storage 315 are combined by the function of the block 317, whereby the final learning correction value KBLRC is produced.

Figure 4:
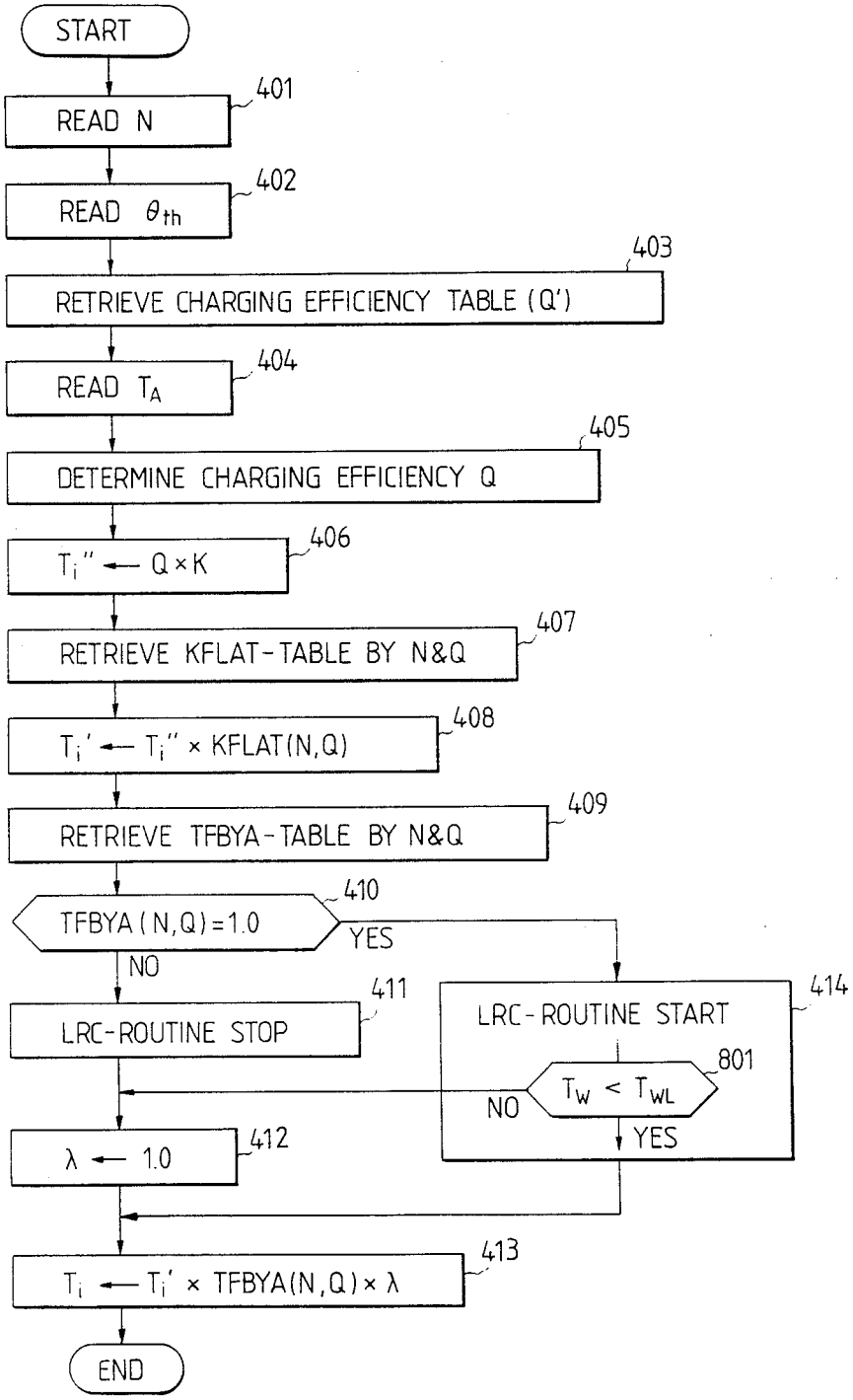
FIG. 4 is a flow chart of the processing operation to be executed by a microprocessor included in the embodiment of FIG. 2 for performing the operation as shown by the functional block diagram of FIG. 3.

Referring next to FIG. 4, in which there is shown a flow chart of the data processing to be executed by the CPU 23, description will be given of the data processing in the following.

A routine shown in this flow chart is executed at predetermined intervals in synchronism with the rotation of the engine 1. After start, the rotational speed N and the throttle valve opening $\theta_{th}$ are read at steps 401 and 402. A table for a charging efficiency of cylinders of the engine 1 is accessed using the read values of N and $\theta_{th}$, and a charging efficiency Q' is obtained at step 403.

The air temperature $T_A$ is read at step 404, and the charging efficiency Q' obtained at step 403 is subject to temperature compensation. As a result, a final charging efficiency Q commensurate with the temperature $T_A$ is determined at step 405. At step 406, the thus obtained charging efficiency Q is multiplied by a predetermined constant K, whereby a preliminary fuel supply amount is determined. The preliminary fuel supply amount in step 406 is indicated as a pulse width $T_i''$ of an injection pulse, which corresponds thereto.

Figure 5:
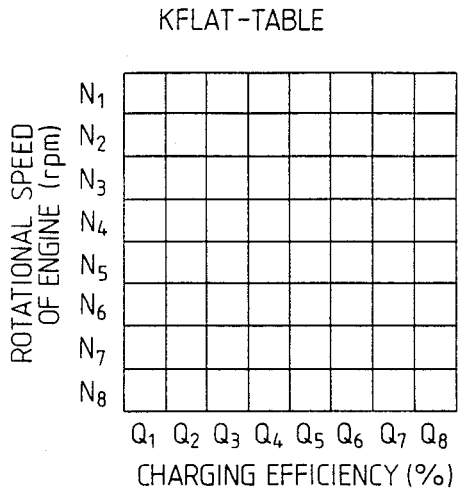
FIG. 5 shows an example of a KFLAT table used in the processing operation of the flow chart of FIG. 4.

Thereafter, the preliminary fuel supply amount $T_i''$ is subject to A/F ratio correction. For this correction, a correction coefficient KFLAT is used, which is obtained by accessing, a KFLAT table using values of N and Q read or determined at steps 401 and 405, respectively. The KFLAT table is provided in the RAM 27 and has plural areas capable of being designated by the operational conditions of the engine 1, i.e., the rotational speeds $N_1$ to $N_8$ and the charging efficiencies $Q_1$ to $Q_8$, as shown in FIG. 5.

At step 407, the accessing of the KFLAT table is executed and the correction coefficient KFLAT(N,Q) is read out therefrom on the basis of the rotational speed N and the charging efficiency Q at that time. Then, at step 408, the preliminary fuel supply amount $T_i''$ is corrected by using the correction coefficient KFLAT(N,Q), whereby a corrected fuel supply amount $T_i'$ is obtained.

Next, it is judged in what condition the engine 1 is now operating. As is well known, an A/F ratio feed-back control is usually controlled in such a manner that a closed loop for the feed-back control is opened and a reference A/F ratio is set at a value richer than the stoichiometric A/F ratio, when the engine 1 is required to operate in the full load region or in the deceleration region.

Figure 6:
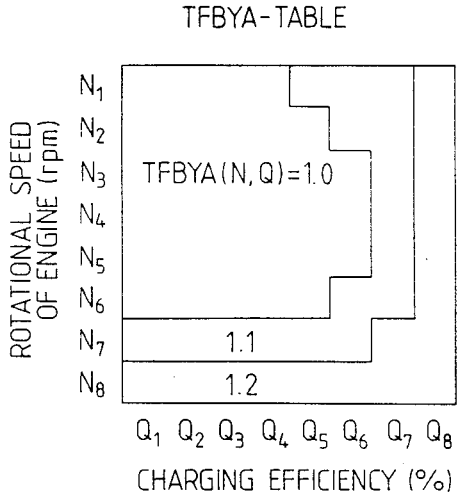
FIG. 6 shows an example of a TFBYA table used in the processing operation of the flow chart of FIG. 4.
Figure 7A:
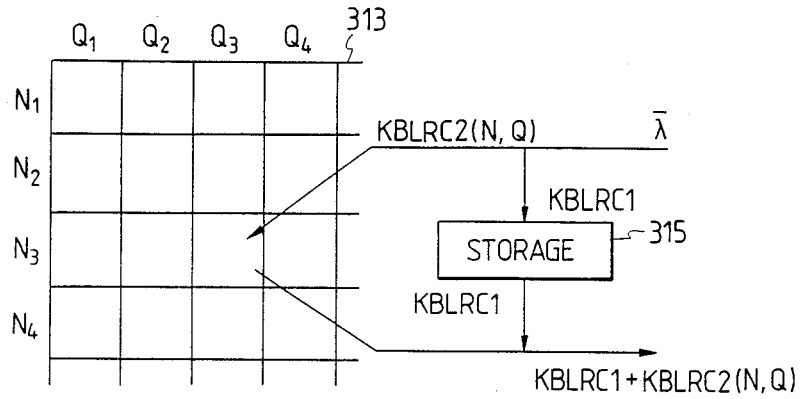
FIGS. 7*a* and 7*b* are drawings for explaining the learning operation for renewing correction values used for finally determining an amount of fuel to be supplied to the engine.
Figure 7B:
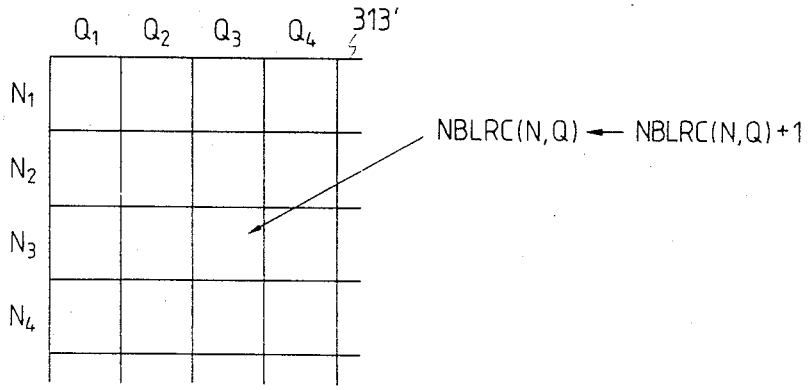

A coefficient for the correction based on the reference A/F ratio is given as a ratio of the stoichiometric A/F ratio to a required A/F ratio, i.e., the reciprocal of an air excess ratio, which is called a reference A/F ratio coefficient and indicated by TFBYA. Similarly to the case of the coefficient KFLAT(N,Q), there is provided in the RAM 27 a TFBYA table, which has plural areas capable of being designated by the operational conditions of the engine 1, i.e., the rotational speeds $N_1$ to $N_8$ and the charging efficiencies $Q_1$ to $Q_8$, as shown in FIG. 6. In each area, there is stored a corresponding coefficient TFBYA(N,Q).

At step 409, therefore, the coefficient TFBYA(N,Q) can be obtained by accessing the TFBYA table using values of the rotational speed N and the charging efficiency Q. Further, in the table of FIG. 6, TFBYA(N,Q)=1.1, for example, means that an A/F ratio, which is 10% richer than the stoichiometric A/F ratio, is to be set as the reference A/F ratio.

Next, at step 410, it is discriminated whether or not the coefficient TFBYA(N,Q) is 1.0. If TFBYA(N,Q) is not 1.0, it means that a reference A/F ratio is not set at the stoichiometric value. At this time, the learning operation can not be carried out, because the closed loop for the feed-back control is opened. If, therefore, a learning (LRC) routine, which will be described later, is running at that time, it is stopped at step 411.

Then, at step 412, it is assumed that the air excess ratio $\lambda$ is 1.0, and the corrected fuel supply amount $T_i'$ is further corrected by using the retrieved value TFBYA(N,Q) and the air excess ratio $\lambda$ at step 413, whereby a final fuel supply amount $T_i$ is determined. The fuel injection is carried out on the basis of the thus obtained final fuel supply amount $T_i$.

If TFBYA(N,Q) is 1.0, it means that a reference A/F ratio is set at the stoichiometric value and the A/F ratio feed-back control is now operating. Therefore, the learning operation is carried out by initiating the LRC routine at step 414. Since an air excess ratio $\lambda$ is identified by the execution of the LRC routine, the final fuel supply amount $T_i$ is determined by further correcting the corrected fuel supply amount $T_i'$ on the basis of the retrieved value TFBYA(N,Q) and the air excess ratio $\lambda$ at step 413. The fuel injection is carried out on the basis of the thus obtained final fuel supply amount $T_i$.

Figure 8:
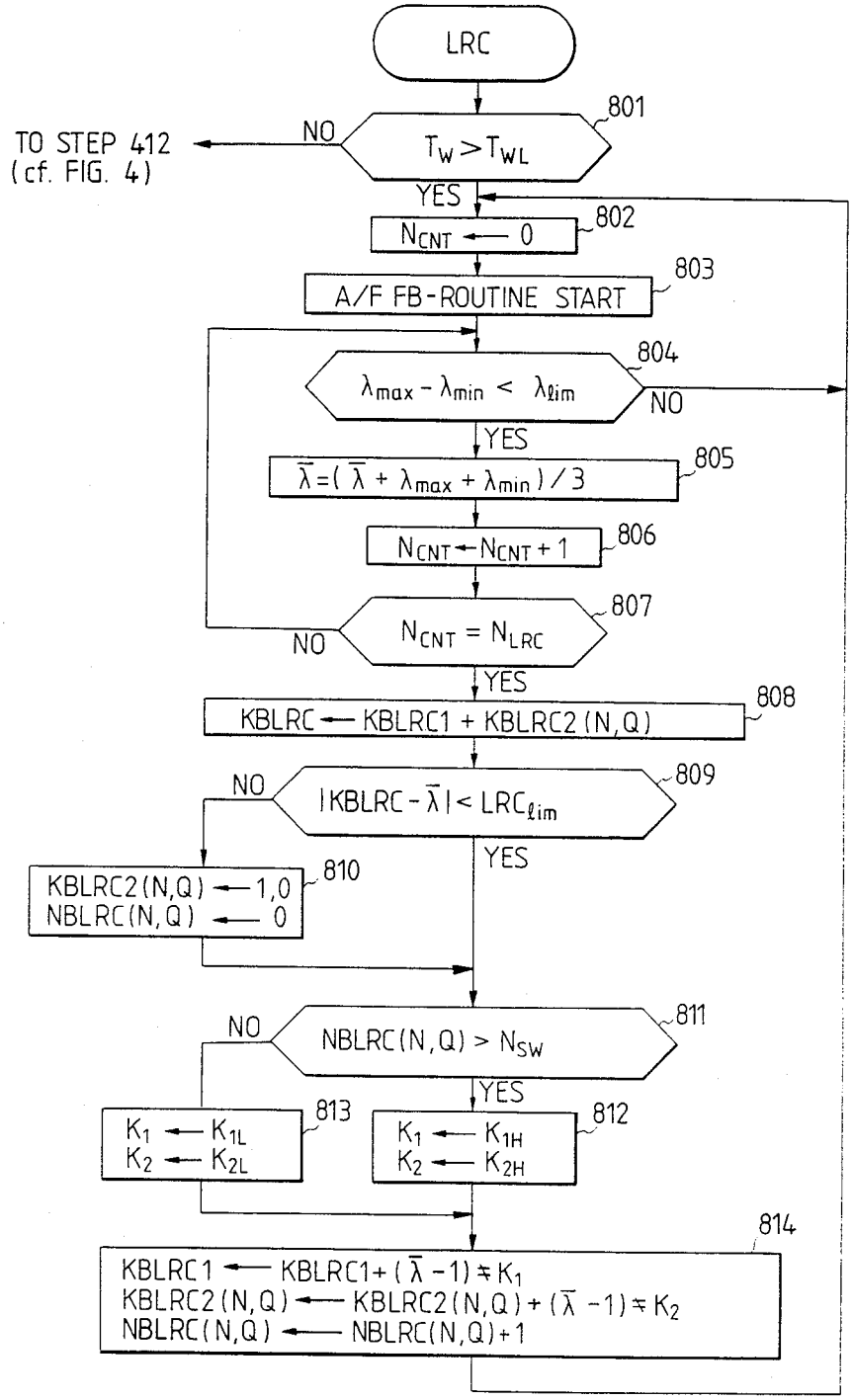
FIG. 8 is a flow chart showing a subroutine LRC (learning control routine) included in the flow chart of FIG. 4.
Figure 9:
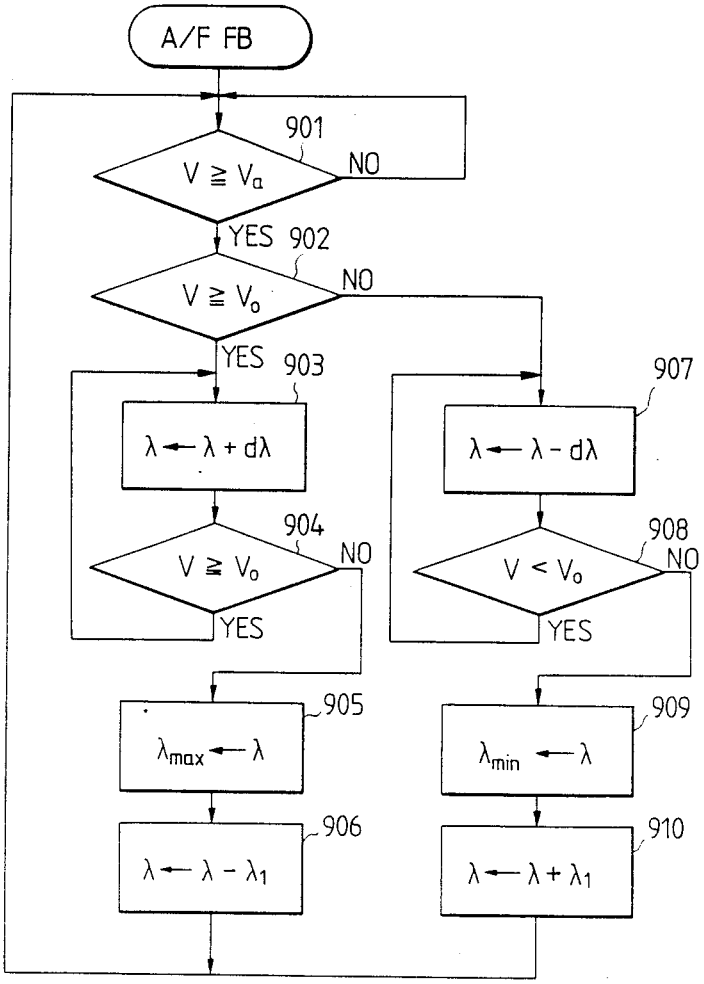
FIG. 9 is a flow chart showing a subroutine A/F FB (A/F ratio feed-back routine) included in the flow chart of FIG. 8.

Referring next to FIG. 8, the aforesaid LRC routine will be described hereinafter. After this routine is initiated by a signal produced at step 410 in the flow chart of FIG. 4, it is at first judged whether or not the engine 1 has been warmed up enough to carry out the learning operation. Namely, at step 801, it is discriminated whether or not the temperature $T_W$ of the cooling water exceeds a predetermined temperature $T_{WL}$, which is selected at a lower limit of the water temperature, at which the effective learning operation is allowed.

If $T_W$ does not reach $T_{WL}$, the operation of this routine jumps to step 412 in the flow chart of FIG. 4 and ends. If $T_W$ exceeds $T_{WL}$, the content $N_{CNT}$ of a counter provided in the RAM 27 is cleared at step 802, and then, at step 803, an A/F ratio feed-back (A/F FB) routine is started, a flow chart of which is shown in FIG. 9. Here, let us describe the A/F FB routine, before a further explanation of the LRC routine of FIG. 8 is given.

At first, at step 901, it is discriminated whether or not an output voltage V of the oxygen sensor 15 exceeds a predetermined value $V_a$, whereby it is judged whether or not the sensor 15 is activated sufficiently for the normal feed-back operation. If V is not larger than $V_a$, the further operation of this routine will wait until the sensor 15 is activated. When V exceeds $V_a$, it is further compared with a predetermined value $V_o$ at step 902, which corresponds to an output voltage of the sensor 15 when a fuel mixture of the stoichiometric A/F ratio is supplied to the engine 1.

If it is discriminated at step 902 that V is larger than $V_o$, the amount of fuel must be decreased, because the fuel mixture supplied at that time is too rich. Namely, it is necessary to increase the air excess ratio λ. Then, at step 903, the air excess ratio λ is increased by adding a predetermined increment dλ to a present air excess ratio λ. With this, the fuel mixture is made leaner.

After that, V is compared again with $V_o$ at step 904. If V is larger than $V_o$, it means that fuel mixture still remains rich. Therefore, the operation returns to step 903, at which the present air excess ratio λ is increased again by further adding the increment dλ thereto. This increase of the air excess ratio λ is repeated until V becomes smaller than $V_o$.

When V became smaller than $V_o$, the air excess ratio λ at that time is stored as $\lambda_{max}$ at step 905. Thereafter, the air excess ratio λ is decreased by a predetermined value $\lambda_i$ at step 906, and the operation returns to step 901.

In contrast to the above, if it is judged at step 902 that V is smaller than $V_o$, the amount of fuel must be increased, because the fuel mixture supplied at that time is lean. Namely, the air excess ratio λ must be decreased. Then, at step 907, the air excess ratio λ is decreased by subtracting the predetermined decrement dλ from a present air excess ratio λ. With this, the fuel mixture is made richer.

Thereafter, V is compared again with $V_o$ at step 908. If V is smaller than $V_o$, it means that the fuel mixture still remains lean. Therefore, the operation returns to step 907, at which the present air excess ratio λ is decreased again by further subtracting dλ therefrom. This decrease of the air excess ratio λ is repeated until V exceeds $V_o$.

Figure 10:
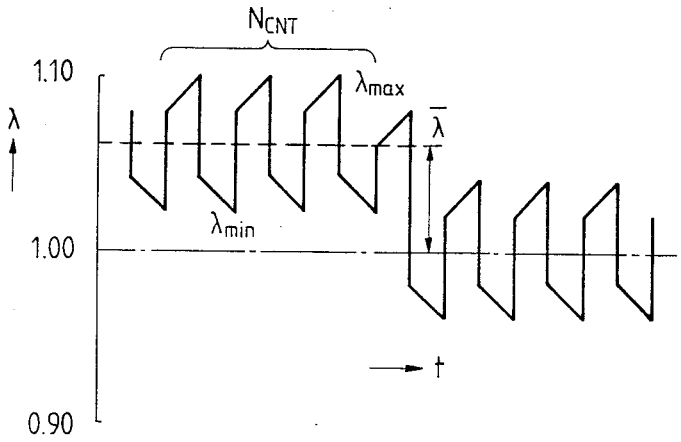
FIG. 10 shows an example of the control result of the A/F FB routine.

When V became larger than $V_o$, the air excess ratio λ at that time is stored as $\lambda_{min}$ at step 909. After that, the air excess ratio λ is increased by the predetermined value $\lambda_i$ at step 910, and the operation returns to step 901. In this manner, the minimum air excess ratio $\lambda_{min}$ and the maximum air excess ratio $\lambda_{max}$ are obtained, and the air excess ratio λ changes as shown in FIG. 10.

Returning to the LRC routine of FIG. 8, it is discriminated at step 804 whether or not a difference between the minimum air excess ratio $\lambda_{min}$ and the maximum one $\lambda_{max}$ resides within a predetermined limit value $\lambda_{lim}$. If the difference is larger than $\lambda_{lim}$, the operation returns to step 802 and the same processing as mentioned above is repeated.

After the difference became smaller than $\lambda_{lim}$, an air excess ratio $\bar{\lambda}$ is renewed at step 705 on the basis of an air excess ratio $\bar{\lambda}$, which was obtained in a previous processing cycle, as well as the minimum air excess ratio $\lambda_{min}$ and the maximum one $\lambda_{max}$, which were obtained in a processing cycle of this time, wherein $\bar{\lambda}$ represents a mean value of the air excess ratio λ changing due to the A/F FB control as already described.

Thereafter, the content $N_{CNT}$ is increased by one at step 806, and then it is discriminated at step 807 whether or not the content $N_{CNT}$ reaches a predetermined value $V_{LRC}$. If the former does not reach the latter, the operation returns to step 804 and the aforesaid renewal of the air excess ratio $\bar{\lambda}$ is repeated until $N_{CNT}$ becomes equal to $N_{LRC}$.

If $N_{CNT}$ reaches $N_{LRC}$, the following processing operation is executed at step 808. Namely, the correction coefficient KBLRC2(N,Q) is at first read out from the map 313 in response to the operational condition of the engine 1. Then, the read-out KBLRC2(N,Q) is added to the deviation coefficient KBLRC1 read out form the storage 315, whereby the learning correction value KBLRC is obtained.

After that, the processing operation goes to steps for the learning operation for renewing the coefficients. At first, it is discriminated at step 809 whether or not the difference between the above obtained learning correction value KBLRC and the mean value $\bar{\lambda}$ of the air excess ratio resides within a predetermined value $LRC_{lim}$.

If the aforesaid difference is within $LRC_{lim}$, the processing operation advances directly to step 811. Otherwise, however, the processing operation goes to step 811 through step 810, at which there are reset the contents KBLRC2(N,Q) and NBLRC(N,Q) stored in the areas of the correction value map 313 and the counter map 313', which areas correspond to the operational condition of the engine 1.

At step 811, the content NBLRC(N,Q) of an area of the counter map 313', i.e., the number of times of the learning operation of the correction value stored in an corresponding area of the map 313, is compared with a predetermined value $N_{SW}$.

If NBLRC(N,Q) exceeds $N_{SW}$, the correction value KBLRC2(N,Q) stored in the area of the map 313 can be considered as being very close to a desirable value thereof, because it has been subject to the learning operation. Otherwise, the number of times of the learning operation many times is insufficient, and therefore the correction value KBLRC2(N,Q) is judged to be not sufficiently close to the desirable value yet.

In response to the discrimination result at step 811, therefore, the ratios for the learning operation are changed over as shown at steps 812 and 813, wherein $K_1$ is a ratio for the learning operation of the correction of the A/F ratio deviation coefficient KBLRC1 and $K_2$ a ratio for the learning operation of the correction of the A/F ratio correction coefficient KBLRC2(N,Q). Further, for every ratio $K_1$ or $K_2$, there are prepared two gains, i.e., $K_{1L}$, $K_{1H}$ and $K_{2L}$, $K_{2H}$, in accordance with the number of times of the learning operation.

After the ratios for the learning operation are determined, new values of the respective coefficients KBLRC1 and KBLRC2(N,Q) are calculated at step 814 by using the determined ratios $K_{1L}$, $K_{2L}$ or $K_{1H}$, $K_{2H}$. The thus obtained coefficient KBLRC1 is stored as a renewed deviation coefficient in the storage 315, and the obtained coefficient KBLRC2(N,Q) is stored as a renewed correction coefficient in the corresponding area of the correction value map 313.

Figure 11:
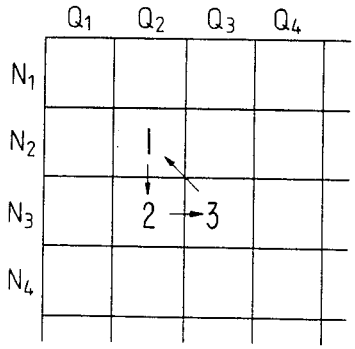
FIG. 11 is a drawing showing an example of the transition of an operational condition of an engine, which is used for explaining the operation of the subroutine LRC.

In the following, there will be presented an example of the learning operation according to the present invention. From this example, the learning operation will become more apparent. In the following explanation, it is assumed that the operational condition of an engine changes in the manner of I → II → III → I, as shown in FIG. 11. Further, an area of the map 313 and an engine operational condition corresponding to the area of the map 313 will be both denoted by the same reference I, II, III, hereinafter.

Moreover, the aforesaid example will be discussed, as two separate cases. In a first case, a set air excess ratio of a fuel mixture supplied to the engine is erroneously shifted to the rich side from the stoichiometric value at the same rate in all the operational conditions I, II and III. This erroneous difference between the set value and the stoichiometric value will be called an initial difference, hereinafter. In a second case, a set A/F ratio of a fuel mixture is erroneously shifted to the rich side from the stoichiometric value only in the operational condition I, and it is correctly set at the stoichiometric value in both the operational conditions II and III.

Figures 12A, 12B, 12C, 12D:
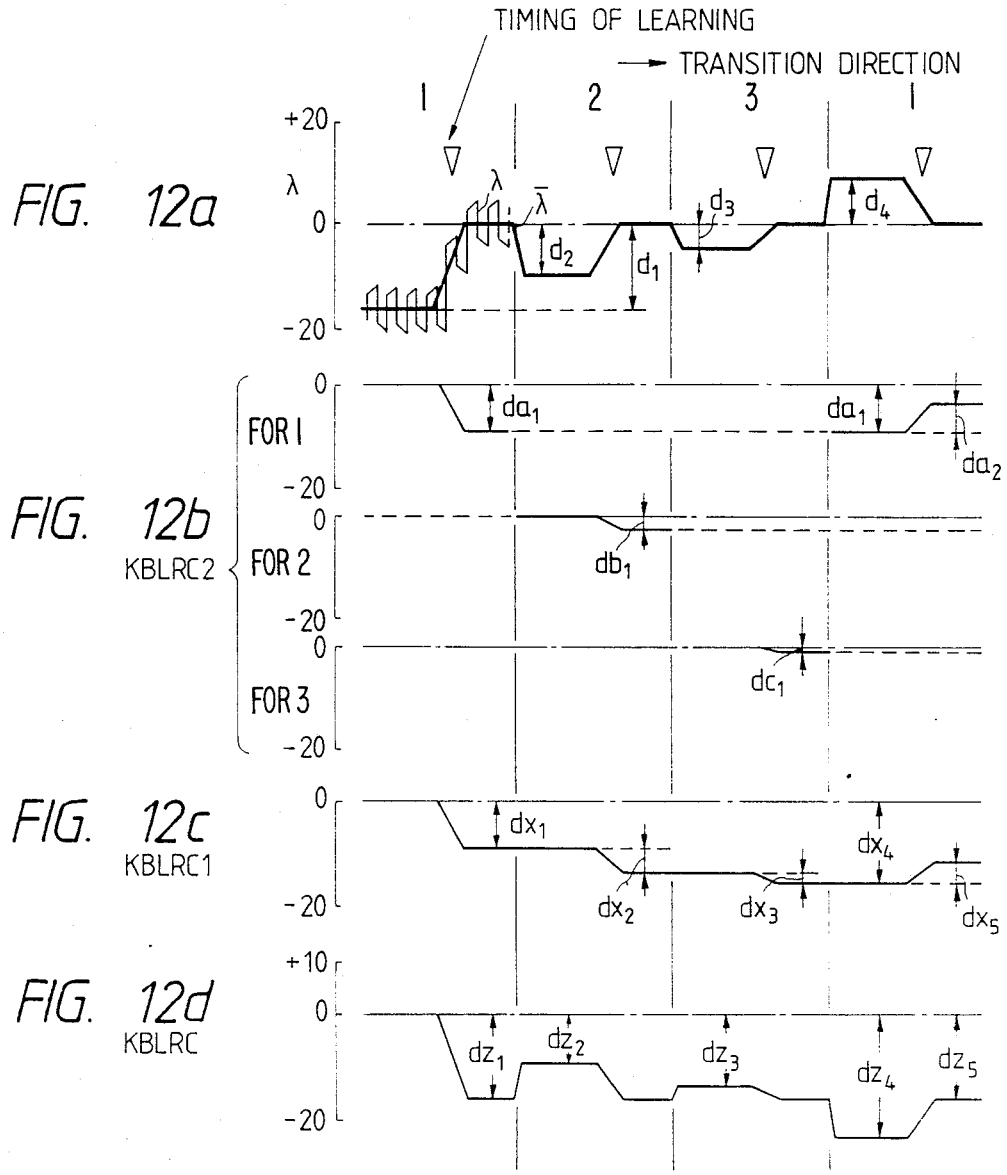
FIGS. 12*a* to 12*d* are drawings for explaining an example of the operation of the subroutine LRC.

Referring at first to FIGS. 12*a* to 12*d*, explanation will be made of the first case. In these drawings, FIG. 12*a* shows the change of the air excess ratio $\lambda$ (thin line) and its mean value $\bar{\lambda}$ (thick line). The ordinate of this figure indicates a difference of the air excess ratio from the stoichiometric value in terms of percentage. Therefore, zero level in this figure represents that the air excess ratio remains at the stoichiometric value. Further, triangles shown in FIG. 12*a* indicate a timing of the learning operation to be executed in the respective operational conditions I, II and III.

FIG. 12*b* shows the change of the correction coefficient KBLRC2(N,Q) stored in the areas I, II and III of the map 313, and FIG. 12*c* the change of the deviation coefficient KBLRC1 stored in the storage 315. As shown in the figures, KBLRC2(N,Q) and KBLRC1 are both zero in the initial state before the execution of the learning operation. Further, FIG. 12*d* shows the change of the learning correction value KBLRC as a summation of KBLRC1 and KBLRC2(N,Q). Also the ordinates of these figures indicate the difference from respective appropriate values in terms of percentage.

When the engine 1 operates in the operational condition I as already mentioned, there occurs a difference between the mean value $\bar{\lambda}$ of the air excess ratio detected by the sensor 15 and the stoichiometric value, because the set A/F ratio in this operational condition has the aforesaid initial difference and both KBLRC1 and KBLRC2 are zero in the initial state before the execution of the learning operation for the first time.

Assuming that the aforesaid initial difference is represented by $d_1$ (cf. FIG. 12*a*), $d_1$ is divided into two components $da_1$ and $dx_1$ in accordance with the predetermined learning ratios $K_2$ and $K_1$, as follows, when the timing of the learning operation comes:

$$da_1 = d_1 \cdot K_2 \text{ and } dx_1 = d_1 \cdot K_1 \quad (1)$$

The component $da_1$ is stored as KBLRC2 in the area I of the map 313, and thereafter the content of the area I is maintained at $da_1$, until the learning operation is executed in this operational condition next time (cf. FIG. 12*b*). The component $dx_1$ is stored as KBLRC1 in the storage 315, and after that, the content of the storage 315 is maintained at $dx_1$, until the learning operation of the next time is executed irrespective of the operational condition (cf. FIG. 12*c*).

Further, KBLRC2 stored in the area I of the map 313 will be represented as KBLRC2(I), hereinafter. The same is applied to KBLRC2 stored in the area II or III of the map 313, i.e., it will be represented as KBLRC2(II) or KBLRC2(III).

Since the learning ratios $K_1$ and $K_2$ are selected such that a summation thereof is equal to 1.0, the learning correction value $dz_1$ as KBLRC (cf. FIG. 12*d*), which is a summation of KBLRC1 and KBLRC2, becomes equal to the initial difference $d_1$. After the learning operation, the A/F ratio of the fuel mixture supplied to the engine 1 is brought about at the stoichiometric value, because the A/F ratio feed-back control is carried out with the thus obtained correction value $dz_1$ (cf. FIG. 12*a*).

Next, there will be discussed the case where the operation of the engine 1 is changed to the operational condition II, after the learning operation as mentioned above has been executed in the operational condition I.

In this case, although KBLRC2(II) is zero before the execution of the learning operation in the operational condition II (cf. FIG. 12*b*), KBLRC1 in the storage 315 is already $dx_1$, which has been obtained by the learning operation in the operational condition I (cf. FIG. 12*c*). Therefore, in this operational condition II, the correction value $dz_2$ as KBLRC (cf. FIG. 12*d*) is formed by only KBLRC1, i.e., $dz_2$ becomes equal to $dx_1$. The set air excess ratio for this operational condition II is corrected by $dz_2$.

Since, as already described, also the set air excess ratio for this operational condition II has the initial difference $d_1$ shifted on the rich side, a difference $d_2$ occurring in this operational condition still remains between the corrected mean value $\bar{\lambda}$ of the air excess ratio and the stoichiometric value, even if the correction based on $dz_2$ is carried out. The difference $d_2$ is represented as follows:

$$d_2 = d_1 - dz_2 = d_1 - dx_1 \quad (2)$$

It will be apparent from the formula above that the difference $d_2$ in the operational condition II is smaller than $d_1$ in the operational condition I, as shown in FIG. 12*a*.

Under the conditions as described above, if the learning operation (second time, but first time for the operational condition II) is carried out, the difference $d_2$ is divided into two components $db_1$ and $dx_2$ in accordance with the predetermined learning ratios $K_2$ and $K_1$, as follows:

$$db_1 = d_2 \cdot K_2 \text{ and } dx_2 = d_2 \cdot K_1 \quad (3)$$

The component $db_1$ is stored as KBLRC2(II) in the area II of the map 313, and thereafter the content of the area II is maintained at $db_1$, until the learning operation is executed in this operational condition next time (cf. FIG. 12*b*). On the other hand, the component $dx_2$ is added to $dx_1$ already stored in the storage 315 (cf. FIG. 12*c*). Therefore, new KBLRC2(II) and KBLRC1 are given by the following formula:

$$\left.\begin{aligned} KBLRC2(II) &= 0 + db_1 \\ KBLRC1 &= dx_1 + dx_2 \end{aligned}\right\} \quad (4)$$

The new KBLRC as a summation of KBLRC1 and KBLRC2(II) given by the above formulas becomes as follows, taking account of the formula (2) and the relationship of $K_1+K_2=1.0$:

$$\begin{aligned} KBLRC &= KBLRC1 + KBLRC2(II) \\ &= dx_1 + dx_2 + db_1 \\ &= dx_1 + d_2 \cdot (K_1 + K_2) \\ &= d_1 - d_2 + d_2 \cdot (K_1 + K_2) \\ &= d_1 \end{aligned} \quad (5)$$

In this manner, the learning correction value KBLRC becomes equal to the initial difference $d_1$ in the set air excess ratio. After the learning operation, therefore, the mean value $\bar{\lambda}$ of the air excess ratio becomes equal to the stoichiometric value with the thus obtained correction value KBLRC.

Similarly, in the operational condition III, since KBLRC1 assumes the value $dx_1+dx_2$, a difference $d_3$ in this operational condition becomes even smaller than $d_2$ in the operational condition II. If the learning operation (third time, but first time for the operational condition III) is executed in this operational condition III, KBLRC2(III) and an increment of KBLRC1 become $dc_1$ and $dx_3$, respectively, both of which are, as apparent from FIGS. 12*b* and 12*c*, smaller than the corresponding values in the operational condition II.

In this manner, KBLRC2 stored in the respective areas of the map 313 becomes smaller and smaller. On the other hand, KBLRC1 stored in the storage 315 is accumulated for every period of the learning operation so that it gradually increases to approach the initial difference $d_1$. When the learning operation in the operational condition III is completed, KBLRC2(I), KBLRC2(II) and KBLRC2(III) stored in the areas I, II and III of the map 313 as well as KBLRC1 stored in the storage 315 are $da_1$, $db_1$ and $dc_1$ as well as $dx_4$, respectively.

Under those conditions, let us assume that the operation of the engine 1 returns to the operational condition I, again. At this time, because KBLRC2(I) is kept as $da_1$, notwithstanding that KBLRC1 increases as much as $dx_4$, the correction value $dz_4$ as KBLRC, which is a summation of KBLRC1 and KBLRC2(I), becomes larger than the initial difference $d_1$ in this operational condition I. As a result, an over correction occurs in the mean value $\bar{\lambda}$ of the air excess ratio, as shown in FIG. 12*a*.

An amount $d_4$ of the over correction, i.e. a difference in the mean value $\bar{\lambda}$ of the air excess ratio in this operational condition from the stoichiometric value, is represented as follows:

$$\begin{aligned} d_4 &= d_1 - dz_4 \\ &= d_1 - (da_1 + dx_4) \\ &= d_1 - da_1 - (dx_1 + dx_2 + dx_3) \end{aligned} \quad (6)$$

Since $d_1$ is equal to $da_1+dx_1$, the formula (6) above is rewritten as follows:

$$d_4 = -(dx_2+dx_3) \quad (7)$$

Under these conditions, if the learning operation is executed, the difference $d_4$ is at first divided into two components $da_2$ and $dx_5$ as shown in FIGS. 12*b* and 12*c* in accordance with the learning ratios $K_2$ and $K_1$. These two components are expressed as follows:

$$da_2 = d_4 \cdot K_2 \text{ and } dx_5 = d_4 \cdot K_1 \quad (8)$$

The thus obtained components are used in order to renew KBLRC1 and KBLRC2(I). Namely, the former as KBLRC1 becomes as follows:

$$\begin{aligned} KBLRC1 &= dx_4 + dx_5 \\ &= dx_4 - (dx_2 + dx_3) \cdot K_1 \\ &= dx_1 + dx_2 + dx_3 - (dx_2 + dx_3) \cdot K_1 \\ &= dx_1 + (dx_2 + dx_3) \cdot (1 - K_1) \end{aligned} \quad (9)$$

As apparent from the formula (9), KBLRC1 at this time does not become smaller than $dx_1$ which resulted from the first period of the learning operation. Further, the latter as KBLRC2(I) becomes as follows:

$$KBLRC2(I) = da_1 + da_2 \quad (10)$$

Since $da_2$ has the sign opposite to that of $da_1$, KBLRC2(I) becomes close to zero by $da_2$. Accordingly, if the learning operation as mentioned above is repeated, KBLRC1 approaches $d_1$, which is the initial difference of the air excess ratio existing in all the operational conditions of the engine 1, and KBLRC2 approaches zero in all the operational conditions.

For example, let us estimate the learning effect of KBLRC1 by three periods of the learning operation as mentioned above, assuming that $K_1$ and $K_2$ are both equal to 0.5. As apparent from FIG. 12*c*, first of all, KBLRC1 is represented as follows:

$$\begin{aligned} KBLRC1 &= dx_1 + dx_2 + dx_3 \\ &= d_1 \cdot K_1 + d_2 \cdot K_1 + d_3 \cdot K_1 \end{aligned} \quad (11)$$

Further, there are the following relationships among $d_1$, $d_2$ and $d_3$;

$$d_2 = d_1 - d_1 \cdot K_1 = d_1 \cdot (1 - K_1)$$

$$d_3 = d_2 - d_2 \cdot K_1 = d_1 (1 - K_1)^2$$

Therefore, the formula (11) above can be rewritten as follows:

$$KBLRC1 = d_1 \cdot 2K_1 - K_1^2 + K_1 \cdot (1 - K_1)^2 \quad (12)$$

Substituting $K_1=K_2=0.5$ into the formula (12), there is obtained $KBLRC1=0.875 \times d_1$. From this, it is understood that 87.5% of the initial difference $d_1$ in the set air excess ratio can be corrected in all the operational conditions by three periods of the learning operation.

Referring next to FIGS. 13*a* to 13*d*, there will be discussed the second case, in which an initial difference in the set air excess ratio exists only in the operational condition I and no initial difference in the operational conditions II and III. Since FIGS. 13*a* to 13*d* correspond to FIGS. 12*a* to 12*d*, respectively, explanation of further details thereof is omitted.

As already described, in this second case, only a set air excess ratio for the operational condition I has an initial difference and air excess ratios for the operational conditions II and III are set at the stoichiometric value. Therefore, when the operation of the engine 1 is in the operational condition I, there occurs a difference between the mean value $\bar{\lambda}$ of the air excess ratio detected by the sensor 15 and the stoichiometric value, because the coefficients KBLRC1 and KBLRC2 are both zero in the initial state before the execution of the learning operation.

Assuming that the aforesaid initial difference is represented by $d_{11}$ (cf. FIG. 13*a*), it is divided into two components $da_{11}$ and $dx_{11}$ in accordance with the predetermined learning ratios $K_2$ and $K_1$, as follows:

$$da_{11}=d_{11}\cdot K_2 \text{ and } dx_{11}=d_{11}\cdot K_1 \tag{13}$$

Figures 13A, 13B, 13C, 13D:
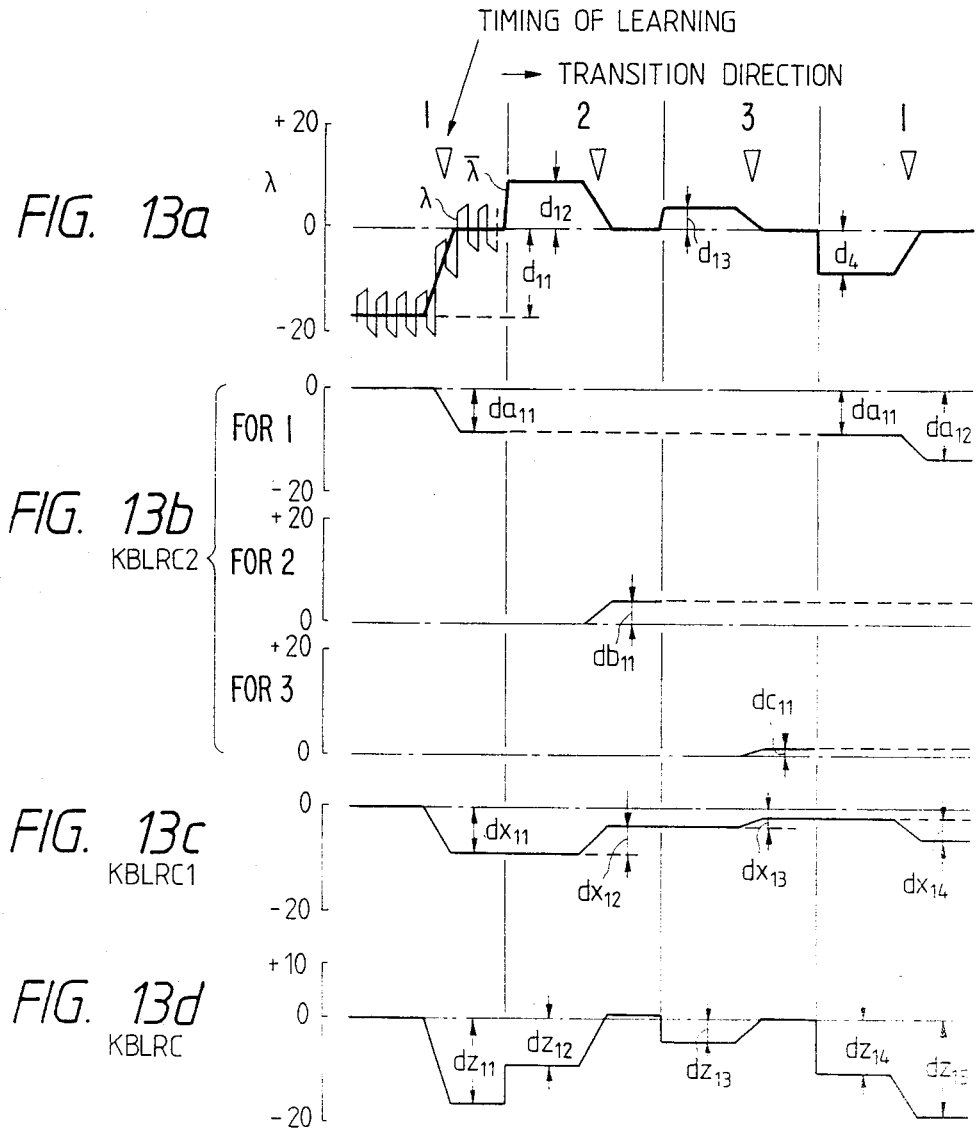
FIGS. 13*a* to 13*d* are drawings for explaining another example of the operation of the subroutine LRC.

When the first periods of the learning operation is executed, the thus obtained $da_{11}$ is stored as KBLRC2(I) in the area I of the map 313 and thereafter maintained, until the learning operation is executed in this operational condition next time (cf. FIG. 13*b*). The obtained $dx_{11}$ is stored as KBLRC1 in the storage 315 and thereafter maintained until the learning operation of the next period is executed irrespective of the operational condition.

After the learning operation (first time), $dz_{11}$ as the learning correction value KBLRC is got by a summation of $da_{11}$ and $dx_{11}$ (cf. FIG. 13*d*). The A/F ratio of the fuel mixture supplied to the engine 1 is brought about at the stoichiometric value, because the A/F ratio feed-back control is carried out with the correction value $dz_{11}$ (cf. FIG. 13*a*).

Thereafter, the operation of the engine 1 changes to the operational condition II. Here, it is to be noted that, as already described, there is no initial difference in the operational condition II in this second case. Further, $dz_{12}$ as the learning correction value KBLRC (cf. FIG. 13*d*) becomes equal to $dx_{11}$, because KBLRC2(II) still remains zero before the execution of the learning operation in this operational condition (cf. FIG. 13*b*).

If the A/F ratio feed-back control is carried out with the air excess ratio corrected by $dz_{12}$, though it has been set properly at the stoichiometric value, an over correction occurs in the mean value $\bar{\lambda}$ of the air excess ratio (cf. FIG. 13*a*). A difference $d_{12}$, which results from the over correction, is represented as follows:

$$d_{12}=0-dz_{12}=-dx_{11}=-d_{11}\cdot K_1 \tag{14}$$

When the learning operation in this operational condition II is executed, the difference $d_{12}$ is divided into two components $db_{11}$ and $dx_{12}$ in accordance with the predetermined learning ratios $K_2$ and $K_1$, as follows:

$$db_{11}=d_{12}\cdot K_2 \text{ and } dx_{12}=d_{12}\cdot K_1 \tag{15}$$

Therefore, KBLRC1 and KBLRC2(II) after the learning operation (second time, but first time for the operational condition II) becomes, as follows:

$$\begin{aligned} KBLRC1 &= dx_{11}+dx_{12} \\ &= dx_{11}+d_{12}\cdot K_1 \\ &= (1-K_1)\cdot K_1\cdot d_{11} \end{aligned} \tag{16}$$

$$\begin{aligned} KBLRC2(II) &= 0+db_{11} \\ &= d_{12}\cdot K_2 \\ &= -d_{11}\cdot K_1\cdot K_2 \end{aligned} \tag{17}$$

Next, the operation of the engine 1 is further changed to the operational condition III, in which there is no initial difference similarity to the case of the operational condition II as already described. Therefore, an over correction in the mean value $\bar{\lambda}$ of the air excess ratio occurs also in this operational condition, because of $dx_{12}$ as KBLRC1.

A difference $d_{13}$ in the mean value $\bar{\lambda}$ of the air excess ratio from the stoichiometric value, which is based on the over correction, becomes as follows:

$$\begin{aligned} d_{13}=-dz_{13} &= -(dx_{11}+dx_{12}) \\ &= -(1-K_1)\cdot K_1\cdot d_{11} \end{aligned} \tag{18}$$

When the learning operation (third time, but first time for the operational condition III) is executed in this operational condition, the difference $d_{13}$ is divided into the following two components in accordance with the predetermined learning ratios $K_2$ and $K_1$:

$$dc_{11}=d_{13}\cdot K_2 \text{ and } dx_{13}=d_{13}\cdot K_1 \tag{19}$$

Accordingly, KBLRC1 and KBLRC2(III) after the learning operation becomes as follows:

$$\begin{aligned} KBLRC1 &= dx_{11}+dx_{12}+dx_{13} \\ &= (1-K_1)\cdot K_1\cdot d_{11}+d_{13}\cdot K_1 \\ &= (1-K_1)\cdot K_1\cdot d_{11}-(1-K_1)\cdot K_1\cdot d_{11}\cdot K_1 \\ &= d_{11}\cdot(K_1-2K_1^2+K_1^3) \\ &= d_{11}\cdot K_1\cdot(1-K_1)^2 \end{aligned} \tag{20}$$

$$\begin{aligned} KBLRC2(III) &= 0+dc_{11} \\ &= d_{13}\cdot K_2 \end{aligned} \tag{21}$$

In this manner, KBLRC1 becomes smaller and smaller every time of the learning operation as mentioned above, as shown in FIG. 13*c*.

Assuming that, under these conditions, the operation of the engine 1 changes to the operational condition I again, an under correction occurs, as shown in FIG. 13*a*, because this operational condition I still has the initial difference $d_{11}$ and nevertheless KBLRC1 has been made very small. A difference $d_{14}$ caused by the under correction is represented as follows:

$$\begin{aligned} d_{14} &= d_{11} - dz_{14} \\ &= d_{11} - da_{11} + (dx_{11} + dx_{12} + dx_{13}) \\ &= d_{11} - d_{11} \cdot K_2 - d_{11} \cdot K_1 \cdot (1 - K_1)^2 \\ &= 1 - K_2 - K_1 \cdot (1 - K_1)^2 \cdot d_{11} \end{aligned} \tag{22}$$

If, therefore, the learning operation is executed again in this operational condition, KBLRC1 and KBLRC2(I) becomes as follows:

$$\begin{aligned} KBLRC1 &= dx_{11} + dx_{12} + dx_{13} + dx_{14} \\ &= dx_{11} + dx_{12} + dx_{13} + d_{14} \cdot K_1 \\ &= K_1 \cdot (2 - 3K_1 + 3K_1^2 - K_1^3 - K_2) \cdot d_{11} \end{aligned} \tag{23}$$

$$\begin{aligned} KBLRC2(I) &= da_{12} \\ &= da_{11} + d_{14} \cdot K_2 \end{aligned} \tag{24}$$

Here let us estimate the learning effect concerning KBLRC2(I) after the execution of the second period of the learning operation, assuming that $K_1$ and $K_2$ are both equal 0.5. The formula (24) is rewritten, as follows:

$$\begin{aligned} KBLRC2(I) &= da_{11} + d_{14} \cdot K_2 \\ &= d_{11} \cdot K_2 + \{1 - K_2 - K_1 \cdot (1 - K_1)^2\} \cdot d_{11} \cdot K_2 \\ &= K_2 \cdot \{2 - K_2 - K_1 \cdot (1 - K_1)^2\} \cdot d_{11} \end{aligned} \tag{25}$$

Substituting $K_1 = K_2 = 0.5$ into the formula (25) above, a value of KBLRC2(I) becomes $0.6875 \times d_{11}$. This means that about 69% of the initial difference $d_{11}$ stored in the area I of the map 313 is corrected in two periods of the learning operation. In this manner, the appropriate renewal of the A/F ratio correction coefficient KBLRC2 in the map 313 and the A/F ratio deviation coefficient KBLRC1 in the storage 315 can be performed by only a few times of the learning operation.

The embodiment described above is advantageous especially in the following. As already described, when an automobile travels in a mountain district, there is the case where the elevation of a road changes widely and the atmospheric pressure changes accordingly. If, in such case, the atmospheric pressure changes very frequently, there increases a chance that the automobile travels with a fuel mixture of an inappropriate A/F ratio.

This results from the fact that an A/F ratio is determined by accessing an A/F ratio correction map, in which only data for the A/F ratio correction obtained by the past learning operation are stored. Many of such data are based on travel in a low land. Therefore, every time an automobile traveling in a mountain district encounters new circumstances, data to be stored in a corresponding area of an A/F ratio correction map must be renewed by the learning operation in response to the new circumstances.

In a conventional control apparatus, an appropriate A/F ratio can not be obtained until the renewal of the A/F ratio correction map is completed. However, a quick and exact correction of an A/F ratio can be achieved by the learning operation according to the present embodiment, without waiting for the completion of the renewal of an A/F ratio correction map. As a result, the A/F ratio of the fuel mixture can be prevented from becoming inappropriate.

By the way, in the embodiment mentioned above, the compensation of an A/F ratio based on the difference in elevation was achieved as a result of the renewal of an A/F ratio correction map by the learning operation. However, an engine is often operated with an A/F ratio which is intentionally deviated from the stoichiometric value, when an automobile travels upward or downward on a sloping road. In such a case, it is preferable to correct the A/F ratio on the basis of a difference in elevation which is directly detected.

Figure 14:
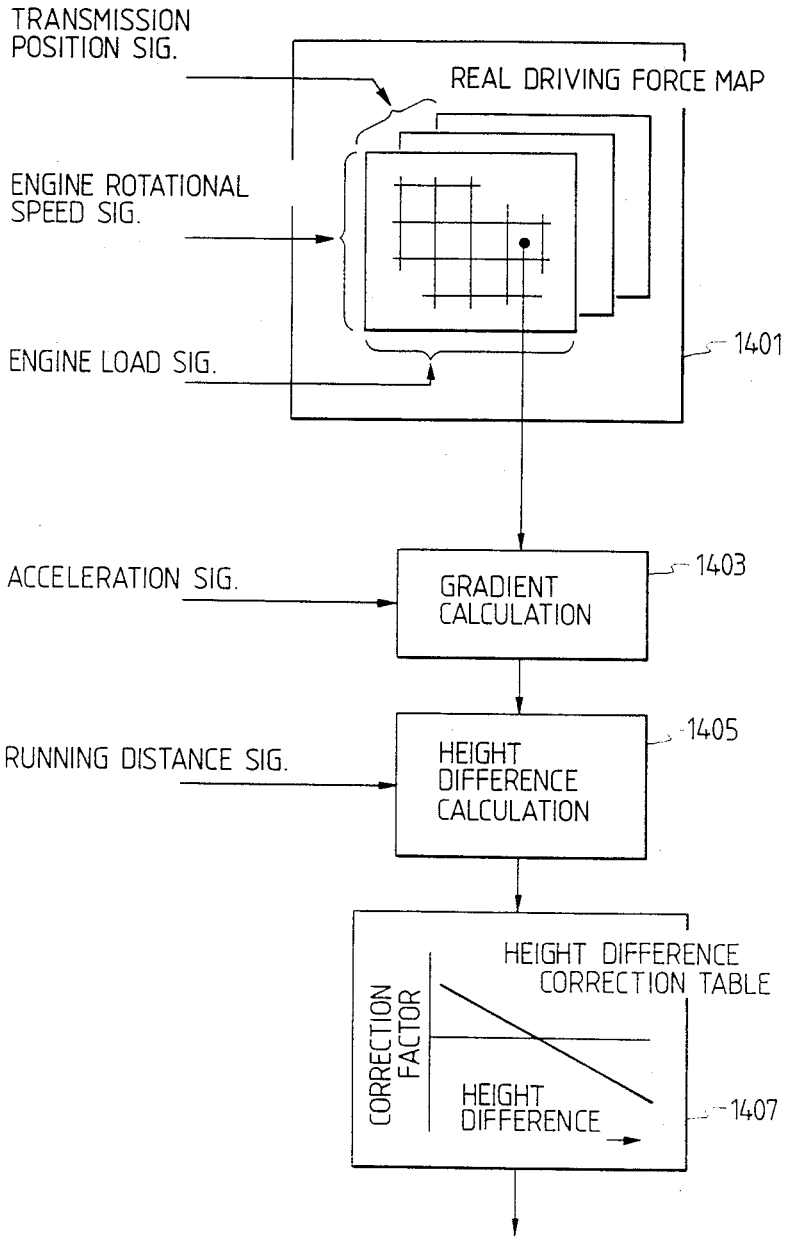
FIG. 14 is a functional block diagram for explaining the operation of a part of another embodiment of the present invention.

Referring next to FIG. 14, explanation will be given of another embodiment, in which the difference in elevation is detected from an operational state of an engine and a detecting error is prevented from diverging.

Similarly to the first embodiment described above, in this embodiment, an intake air amount is calculated from the rotational speed N obtained on the basis of the crank angle signals from the sensor 19 and the throttle opening signal $\theta_{th}$ from the sensor 11, and a preliminary fuel supply amount is determined on the basis of the thus obtained intake air amount. Further, the preliminary fuel supply amount is subject to various corrections, including the correction based on the A/F ratio detected by the sensor 15, whereby a final fuel supply amount is determined and fuel injection is carried out accordingly.

In addition thereto, this embodiment is provided with the following function. In FIG. 14 there is shown a functional block diagram of the function to be executed by the control unit 21 in accordance with this embodiment. For this function, there is provided a map 1401 for obtaining a real driving force available for moving an automobile.

Assuming that a driving force produced by an engine is indicated by F and a running resistance of the automobile by $F_L$, a real driving force $F_R$ is represented as follows:

$$F_R = F - F_L \tag{26}$$

The driving force F can be determined in advance as one of performances of the automobile on the basis of the rotational speed N of the engine 1, the load thereof and the gear position of the transmission. Since, therefore, the running resistance $F_L$ is also obtained in advance experimentally and empirically, the real driving force $F_R$ can be obtained in advance as a function of the rotational speed N of the engine 1, the load thereof and the gear position of the transmission.

Therefore, the map 1401 includes plural tables corresponding to the gear positions of the transmission, one of which can be selected in response to a transmission position signal, which is produced by a known sensor (not shown) installed on the transmission.

Each table of the map 1401 has plural areas capable of being designated by a rotational speed N of the engine 1 and the load thereof. In each of the plural areas, there is stored a real driving force of an automobile obtained in a manner as mentioned above. During the control, therefore, a real driving force $F_R$ can be obtained quickly by retrieving the table selected by the transmission position signal in accordance with an engine rotational speed signal and an engine load signal.

Figure 15:
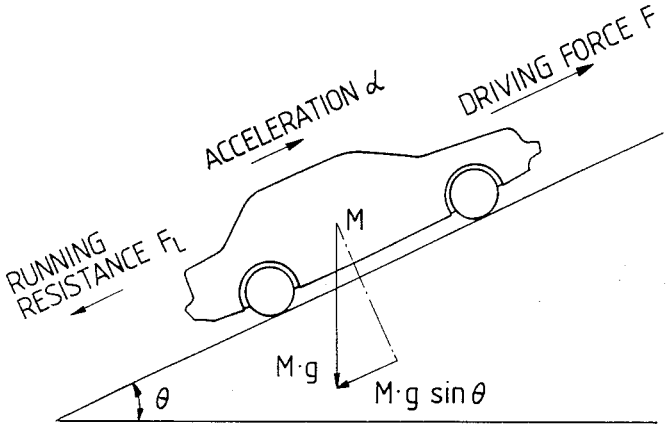
FIG. 15 is a drawing for explaining the principle of obtaining the difference elevation of the traveling position of an automobile in the another embodiment.

Next, the gradient of a sloping road is calculated on the basis of the thus obtained real driving force $F_R$ (cf.

block 1043). This calculation is based on the following known principle. Assuming that various forces acting on an automobile exist in equilibrium, when the automobile runs on an uphill slope, as shown in FIG. 15, the following formula is established:

$$\alpha M = F - F_L - g \cdot M \cdot \sin\theta \quad (27)$$

wherein

M: weight of an automobile, g: gravitational acceleration, $\alpha$: acceleration of the automobile, and $\theta$: gradient of a sloping road.

Therefore, the gradient of the sloping road can be obtained as follows:

$$\sin\theta = (F_R - \alpha \cdot M)/g \cdot M \quad (28)$$

The acceleration $\alpha$ of the automobile used in the formula above can be obtained by differentiating the speed of the automobile with respect to time. The speed of the automobile is obtained on the basis of the crank angle signal produced by the sensor 19.

The thus obtained gradient $\sin\theta$ is integrated by a travel distance, whereby an elevation difference can be obtained (cf. block 1405). The travel distance is easily obtained by a travel distance meter usually provided in an automobile.

After the elevation difference is obtained, a correction factor based thereon is determined. The determination of this factor is carried out by using an elevation difference correction table (cf. block 1407). The characteristics of this table are shown in FIG. 16.

Figure 16:
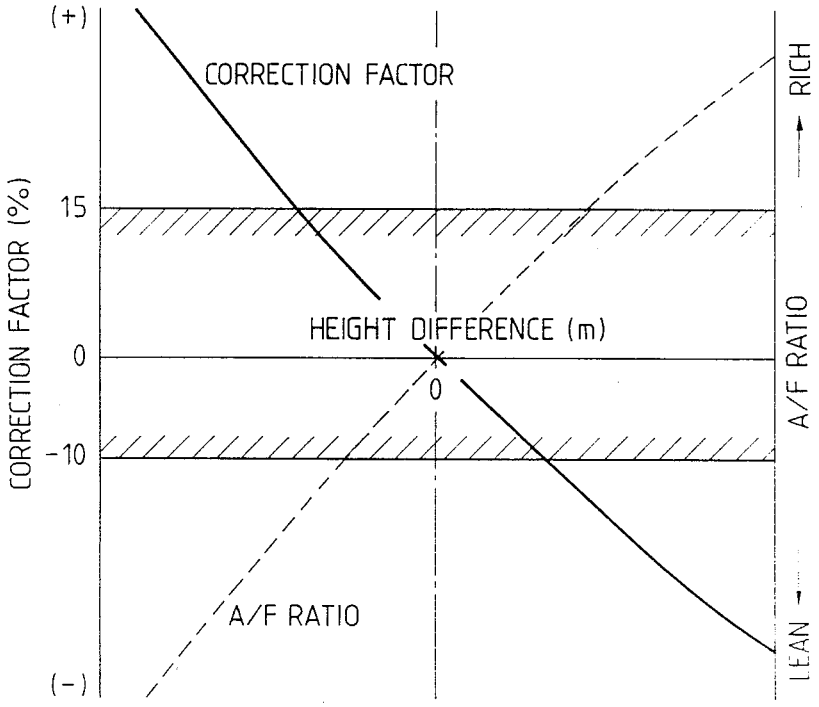
FIG. 16 shows an example of the characteristics of a correction factor table used in the another embodiment.

As shown by a broken line in FIG. 16, as a traveling position of an automobile becomes higher than a present position (height difference=0), the density of air decreases, whereby a fuel mixture is made relatively rich as much. Therefore, the correction based on the elevation difference is carried out such that the mixture is made lean by an A/F ratio commensurate with the change of the density of air, i.e., the elevation difference. Accordingly, the characteristics of the table 1407 have a decreasing trend with respect to the elevation difference, as shown by a solid line in FIG. 16.

Figure 17:
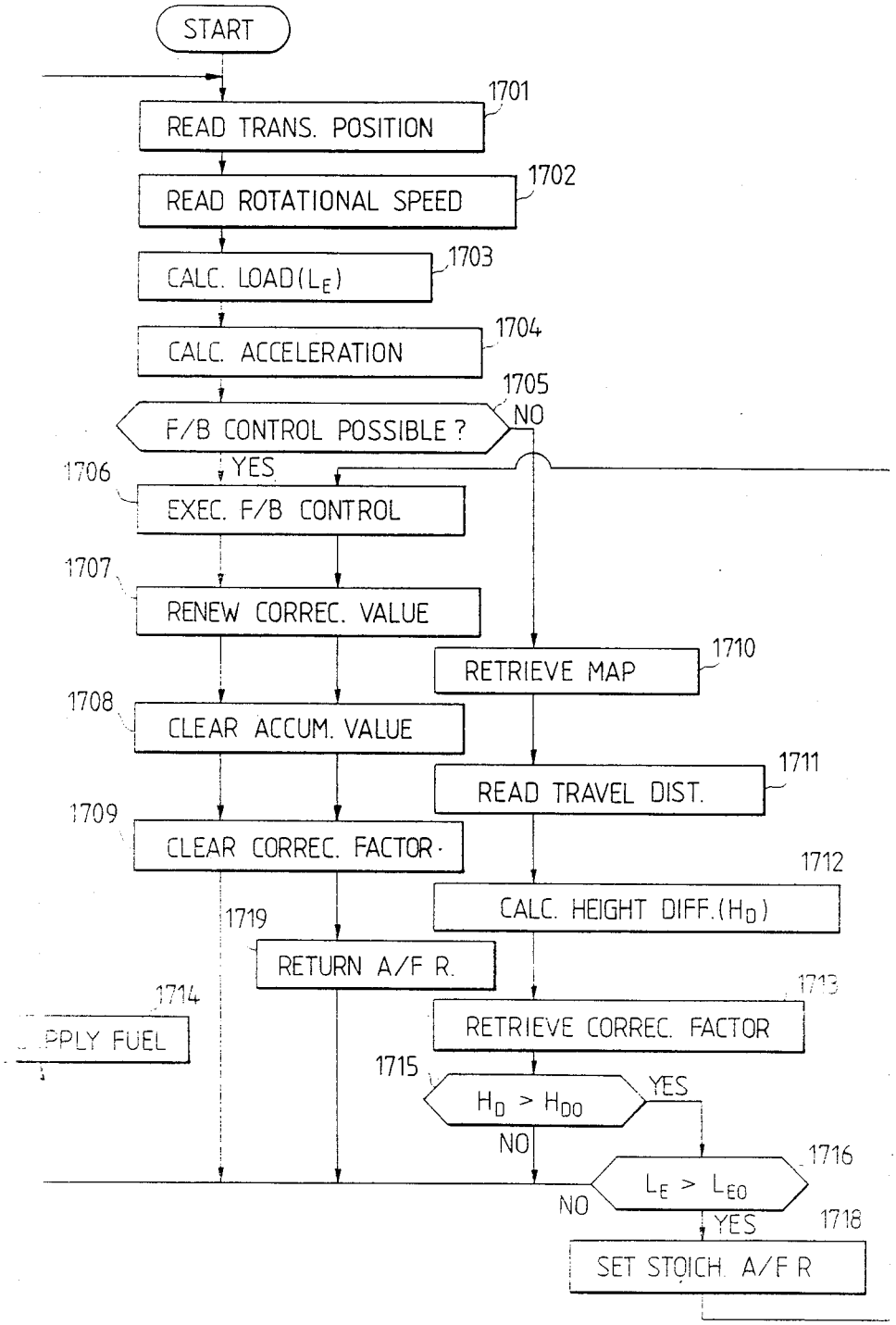
FIG. 17 is a flow chart of the processing operation to be executed by a microprocessor for performing the operation as shown by the functional block diagram of FIG. 14.

In the following, a further detailed description will be made of a processing operation to be executed by the control unit 21, referring to FIG. 17 showing a flow chart of this processing operation.

After the start of the processing operation, signals indicating the gear position of the transmission and a rotational speed of the engine 1 are read at steps 1701 and 1702. Further, based thereon, the load $L_E$ of the engine 1 and the acceleration of the automobile are calculated at steps 1703 and 1704.

Figure 18:
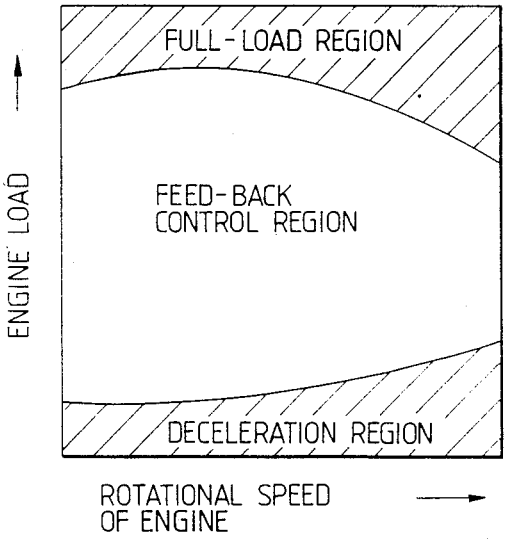
FIG. 18 is an example of a table used for judging whether or not the operation of the engine falls into the A/F ratio feed-back control region.

Next, at step 1705, it is discriminated whether or not A/F ratio feed-back control is possible. As already described, there is a specific region of the operational condition, in which the A/F ratio feed-back control is possible. An example thereof is shown in FIG. 18. As apparent from the figure, the feed-back control region can be judged by the rotational speed of the engine 1 and the load thereof.

If the discrimination at step 1705 is affirmative, the A/F ratio feed-back control is executed at step 1706. On the basis of the result thereof, the correction value is renewed at step 1707. Thereafter, the accumulated value of the height difference is cleared at step 1708. This is because when the correction value is renewed, the position of the automobile at that time is established as a reference position (elevation difference=0) in the height difference correction table (cf. FIG. 16).

Further, at step 1709, the correction factor based on the elevation difference is cleared, too, because an amount to be corrected based on the elevation difference is included in the correction value renewed at step 1707. After that, a fuel supply is carried out at step 1714, and the processing operation returns to the beginning.

On the contrary, if it is discriminated at step 1705 that the A/F ratio feed-back control is impossible, the real driving force map is accessed at step 1710, whereby the real driving force at that time is obtained. Further, the travel distance is read at step 1711.

Then, the gradient of a sloping road is at first calculated in accordance with the aforesaid formula (28) on the basis of the thus obtained real driving force and the acceleration already calculated at step 1704. At step 1712, the height difference $H_D$ is calculated by integrating the gradient with respect to the travel distance read at step 1711.

On the basis of the thus obtained elevation difference, the elevation difference correction table is retrieved at step 1713, whereby a correction factor based on the elevation difference can be obtained. Although there are shown succeeding steps 1715, 1716 and 1718, these steps will be explained later.

The thus obtained correction factor is added to the learning correction value already described, and a final correction coefficient is determined. Then, the fuel injection is carried out at step 1714 in response to the fuel supply amount corrected by the final correction coefficient. Thereafter, the processing operation returns to step 1701.

According to this embodiment, the correction can be carried out based on the elevation difference without using any special sensor for detecting an atmospheric pressure, whereby a fuel mixture of the appropriate A/F ratio can be supplied in response to the elevation of the road on which an automobile travels. Further, according to the embodiment, since a map is used in order to determine a real driving force acting on an automobile at that time, the processing for the elevation difference correction is executed very quickly and therefore a good controllability can be easily achieved.

Moreover, in this embodiment, a correction factor is determined on the basis of the elevation difference between the present position of an automobile and the position thereof at which the correction factor was obtained last time. Namely, the renewal of a correction factor according to the embodiment is based on the relative elevation difference. Since, however, the elevation difference is cleared every time when the operation of the engine 1 falls into the condition, in which the A/F ratio feedback control is possible, the renewal of a correction factor can be achieved exactly to the same extent as that based on the absolute elevation difference.

In the embodiment described above, however, a correction factor based on the elevation difference is renewed by an open loop A/F ratio control. With such an open loop control, the following disadvantage may occur. Namely, when a calculated elevation difference shows an abnormal value because of some reasons, including a malfunction of the control loop, such an abnormality can not be recognized.

Although the weight M of an automobile and the real driving force $F_R$ in the formula (28) were treated as being constant, they are not always constant actually.

The weight M of an automobile changes in accordance with the number of passengers within the automobile, and also the real driving force $F_R$ is different for every automobile and also varies in accordance with traveling circumstances. As a result, an error may be included in the calculation of the gradient of a sloping road.

Then, the processing composed of steps 1715, 1716 and 1718 is further added in the flow chart of FIG. 17, in order to solve the aforesaid disadvantage. Namely, in an improvement, it is at first discriminated at step 1715 whether or not the elevation difference $H_D$ calculated at step 1712 continuously changes to reach a predetermined value $H_{DO}$, for example 500 m.

If $H_D$ does not yet reach the predetermined value $H_{DO}$, the processing operation goes to step 1714, at which the predetermined amount of fuel is supplied. Otherwise, the processing operation goes to step 1716 added by this improvement, at which it is further discriminated whether or not the engine load $L_E$ calculated at step 1703 is larger than a predetermined value $L_{EO}$.

If $L_E$ is smaller than $L_{EO}$, the processing operation goes to step 1714, at which a predetermined amount of fuel is supplied. If $L_E$ exceeds $L_{EO}$, the processing operation jumps back to step 1760, after a reference A/F ratio is changed over to the stoichiometric A/F ratio at step 1718.

As a result, the A/F ratio feed-back control based on the output signal from the oxygen sensor 15 is initiated to thereby execute the learning operation in the same manner as already described. Thereafter, the predetermined amount of fuel is supplied at step 1714. In this case, however, there is provided step 1719 after step 1709, at which the A/F ratio provisionally set at the stoichiometric value at step 1718 is returned to the original reference A/F ratio.

According to this improved embodiment, even if an automobile continuously runs on a sloping road for a long time, an abnormality which occurs in the correction operation of the A/F ratio, caused by an accumulated error in the detection of the elevation difference, can be prevented.

We claim:

1. A fuel supply control apparatus for an internal combustion engine, comprising:

an operational condition sensor for detecting an operational condition of the engine, including at least a rotational speed of the engine and a load thereof;

an oxygen sensor for detecting an air/fuel (A/F) ratio of a fuel mixture supplied to the engine; and a control unit, including a microprocessor, which is programmed to execute the following steps:

calculating a preliminary amount of fuel to be supplied to the engine on the basis of the operational condition of the engine;

retrieving (1) an A/F ratio correction coefficient from a correction map provided din a memory of the microprocessor in accordance with an operational condition of the engine, the map having plural storage areas, each capable of being designated by a value of at least one operational condition of the engine, for storing A/F ratio correction coefficient, and (2) an A/F ratio deviation coefficient from an additional storage provided in said memory;

determining a correction value by combining said A/F ratio correction coefficient and said A/F ratio deviation coefficient obtained in said retrieving step;

determining a final amount of fuel to be supplied to the engine by correcting the preliminary fuel supply amount on the basis of the correction value; and renewing the correction value used for the determination of a final fuel supply amount on the basis of the a/F ratio detected by said oxygen sensor, when the engine is in an operation state in which A/F ratio feed-back control is possible;

said microprocessor executing the following steps in order to renew said correction value:

obtaining a difference between an A/F ratio detected by said oxygen sensor and a reference A/F ratio set for a/F ratio feed-back control;

dividing said difference into two components to form an A/F ratio correction coefficient and an A/F ratio deviation coefficient, in accordance with a predetermined ratio, wherein a summation of said two components forms said correction value; and storing the A/F ratio correction coefficient in an area of the correction map corresponding to the operational condition of the engine and the accumulating the A/F ratio deviation coefficient in the additional storage without regard to an operational condition of the engine.

2. A fuel supply control apparatus for an internal combustion engine according to claim 1, wherein said microprocessor counts a number of times of renewal of a correction coefficient stored in an area of the correction map and the ratio for dividing said difference is changed over in accordance with the counted number of times of renewal of the correction coefficient.

3. A fuel supply control apparatus for an internal combustion engine according to claim 2, wherein, when the number of times of renewal is larger than a predetermined value, a first ratio is used and when the number of times of renewal is smaller than the predetermined value, a second ratio is used, which is different from the first ratio.

4. A fuel supply control apparatus for an internal combustion engine according to claim 2, wherein the correction map comprises a correction value map and a counter map, both of which have a plurality of storage areas corresponding to each other and capable of being designated by the operational condition of the engine, wherein the correction value map stores the A/F ratio correction coefficients and the counter map stores a number of times of renewal of an A/F ratio correction coefficient of a corresponding area of the correction value map.

5. A fuel supply control apparatus for an internal combustion engine according to claim 1, wherein the microprocessor is provided in the memory thereof with a real driving force map, which has plural storage area, capable of being designated by the operational condition of the engine, each storage area storing a real driving force available for traveling of an automobile in the respective operational condition, said microprocessor executing the following steps in order to further correct the correction value:

accessing the real driving force map in response to the operational condition of the engine to obtain a real driving force available at that time;

calculating a gradient of a sloping road, on which the automobile is now traveling, on the basis of said real driving force and an acceleration acting on the automobile;

calculating an elevation difference of a traveling position of the automobile on the basis of the gradient of the road and a running distance of the automobile; and obtaining a correction factor for further correcting the correction value in accordance with the calculated elevation difference.

6. A fuel supply control apparatus for an internal combustion engine according to claim 5, wherein the real driving force map comprises plural tables, each of which has plural storage areas, capable of being designated by the operational condition of the engine, each storage area storing a real driving force, and in which one of the tables is selected in response to a gear position of a transmission.

7. A fuel supply control apparatus for an internal combustion engine according to claim 5, wherein every time the calculated elevation difference reaches a predetermined value, a correction factor obtained at that time is cleared, after the correction value is corrected on the basis of the correction factor.

8. A fuel supply control method for an internal combustion engine in which a preliminary amount of fuel to be supplied to the engine is calculated on the basis of at least one detected operational condition of the engine and a final amount of fuel to be supplied to the engine is calculated by correcting the preliminary fuel supply amount using a correction value, the method comprising the steps, which are repeated periodically, of:

(a) detecting an air-fuel ratio of a fuel mixture supplied to the engine;

(b) determining the difference between the detected air-fuel ratio and a reference air-fuel ratio;

(c) dividing said difference into two components in accordance with a predetermined ratio to form an A/F ratio correction coefficient and an A/F ratio deviation coefficient;

(d) storing the A/F ratio correction coefficient in a storage area of a correction map stored in a digital memory according to a current value of at least one operational condition of the engine, said correction map having plural storage areas corresponding to respective values of said one operational condition;

(e) accumulating values of said A/F ratio deviation coefficient and storing an accumulated value thereof in a further area of said digital memory without regard to an operational condition of the engine; and (f) calculating said correction value for a current value of an operating condition of the engine by reading out of said correction map of A/F correction coefficient for said current value of the operating condition and combining the read-out A/F ratio correction coefficient with the accumulated value of the A/F ratio deviation coefficient in said further area of said digital memory.

9. A fuel supply control method according to claim 8, further comprising the steps of:

(g) counting the number of times a value of the A/F ratio correction coefficient is stored in each storage area of said correction map;

(h) detecting when the number counted in step (g) for a given storage area reaches a predetermined value; and (i) changing said predetermined ratio used in step (c) for said given storage area.

10. A fuel supply control method according to claim 9, wherein said step (g) includes storing count values for each storage area of said correction map in corresponding storage areas of a counter map, which is also stored in said digital memory.

11. A fuel supply control method according to claim 8, further including the steps of:

(g) storing respective storage means of said digital memory a map of values of real driving force for respective values of an operational condition of the engine;

(h) accessing the real driving force map in response to the operational condition of the engine to obtain a real driving force available at that time;

(i) calculating a gradient of a sloping road, on which the automobile is now traveling, on the basis of said real driving force and an acceleration acting on the automobile;

(j) calculating an elevation difference of a traveling position of the automobile on the basis of the gradient of the road and a running distance of the automobile; and (k) obtaining a correction factor for further correcting the correction value in accordance with the calculated elevation difference.

12. A fuel supply control method for an internal combustion engine according to claim 11, wherein the real driving force map comprises plural tables, each of which has plural storage areas, capable of being designated by the operational condition of the engine, each storage area storing a real driving force, and in which one of the tables is selected in response to a gear position of a transmission.

13. A fuel supply control method for an internal combustion engine according to claim 11, wherein every time the calculated elevation difference reaches a predetermined value, a correction factor obtained at that time is cleared, after the correction value is corrected on the basis of the correction factor.

* * * * *